US008182399B2

(12) United States Patent
Davis et al.

(10) Patent No.: US 8,182,399 B2
(45) Date of Patent: May 22, 2012

(54) FOLDABLE TREADMILL

(75) Inventors: Christopher P. Davis, Marshall, WI (US); Nathan Pyles, Lake Mills, WI (US); Mrako A. Fenster, Madison, WI (US)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 407 days.

(21) Appl. No.: 12/163,597

(22) Filed: Jun. 27, 2008

(65) Prior Publication Data

US 2009/0005224 A1 Jan. 1, 2009

Related U.S. Application Data

(60) Provisional application No. 60/946,616, filed on Jun. 27, 2007.

(51) Int. Cl.
*A63B 22/02* (2006.01)

(52) U.S. Cl. ..... 482/54

(58) Field of Classification Search ..... 482/51, 482/54, 908
See application file for complete search history.

(56) References Cited

U.S. PATENT DOCUMENTS 3,650,529 A * 3/1972 Salm et al. ..... 482/54
4,026,545 A 5/1977 Schonenberger
4,066,257 A * 1/1978 Moller ..... 482/54
4,679,787 A 7/1987 Guilbault
5,669,857 A 9/1997 Watterson et al.
5,672,140 A * 9/1997 Watterson et al. ..... 482/54
5,683,332 A 11/1997 Watterson et al.
5,702,325 A 12/1997 Watterson et al.
5,704,879 A 1/1998 Watterson et al.
5,718,657 A 2/1998 Dalebout et al.
5,733,228 A * 3/1998 Stevens ..... 482/54
5,743,833 A 4/1998 Watterson et al.
5,813,947 A 9/1998 Densmore
5,860,893 A 1/1999 Watterson et al.
5,899,834 A 5/1999 Dalebout et al.
6,033,347 A 3/2000 Dalebout et al.
6,152,860 A * 11/2000 Wang ..... 482/54
6,224,516 B1 5/2001 Disch
6,450,923 B1 * 9/2002 Vatti ..... 482/8
6,494,814 B1 * 12/2002 Wang et al. ..... 482/54
6,508,744 B1 1/2003 Carolus
6,520,890 B2 2/2003 Hsu
6,808,475 B2 10/2004 Kehrbaum
6,872,168 B2 * 3/2005 Wang et al. ..... 482/54
7,022,050 B2 4/2006 Sankrithi (Continued)

*Primary Examiner* — Stephen Crow
(74) *Attorney, Agent, or Firm* — Michael Best & Friedrich LLP

(57) ABSTRACT

A foldable treadmill comprising a base bracket, a deck coupled to the base bracket for moving between a use position and a stored position, a support post extending upwardly and movably coupled to the deck, and a handle pivotally connected to the support post. A handle linkage can be coupled to the handle, and a lifting device can be coupled between the base bracket and the handle linkage for moving the handle when the deck is being moved. In one embodiment, the lifting device includes a support rod coupled to the support post and a deck rod coupled between the base bracket and the support rod. In this embodiment, the support rod has a first portion slidably coupled to the deck and another portion coupled to the handle linkage. The treadmill can further include a control panel movably coupled to the top portion of the support post. Preferably, a link bar is coupled between the control panel and the handle for moving the control panel when the deck is being moved.

5 Claims, 23 Drawing Sheets

U.S. PATENT DOCUMENTS

| | | | | |
|---|---|---|---|---|
| 7,037,241 | B2 | 5/2006 | Kuo | |
| 7,052,441 | B2 | 5/2006 | Sankrithi | |
| 7,192,388 | B2 * | 3/2007 | Dalebout et al. | 482/54 |
| 7,291,096 | B2 * | 11/2007 | Ho et al. | 482/54 |
| 7,357,758 | B2 * | 4/2008 | Polk et al. | 482/54 |
| 7,540,829 | B1 * | 6/2009 | Chen | 482/54 |
| 7,637,850 | B2 * | 12/2009 | Chen | 482/54 |
| 2007/0066448 | A1 * | 3/2007 | Pan et al. | 482/54 |
| 2007/0219056 | A1 * | 9/2007 | Lo | 482/8 |
| 2008/0280734 | A1 * | 11/2008 | Dickie et al. | 482/54 |
| 2009/0111666 | A1 * | 4/2009 | Wang | 482/54 |

* cited by examiner

FOLDABLE TREADMILL

FIELD OF THE INVENTION

The present invention relates to a treadmill and, more particularly, to a foldable treadmill.

SUMMARY

Indoor exercise is getting more and more popular during recent decades. One popular indoor exercise apparatus is the treadmill.

Treadmills commonly include an elongated deck supported on the floor in the exercise area, a panel support extending upward from a front end of the deck and two handles extending substantially horizontally from the panel support. The deck typically includes two rollers positioned at opposite ends of the deck and an endless belt suspended between the rollers. A user may step on the endless belt for walking, running or other exercise purpose. Even when the treadmill is not in use, it must remain in its "use" condition, with the deck typically remaining on the floor surface and the control panel support and the handles remaining fixed in position.

One drawback of such a treadmill is that the deck and the support and handles occupy a considerable amount space, especially for those personal users who place the treadmill in their homes. Even if the deck is movable, the fixed-position panel support and handles still occupy a considerable amount space. The space requirement may even discourage some potential purchasers who have relatively limited available space, e.g., in a home.

In addition, such a treadmill cannot be shipped in an assembled condition from the manufacturer to the distributor and/or to the consumer. Accordingly, the disassembled treadmill needs to be assembled in the exercise area by the distributor or by the consumer, which is undesirable.

The present invention provides a foldable treadmill comprising a base bracket adapted to rest on a surface, a deck coupled to the base bracket for moving between a use position and a stored position, at least a support post extending upwardly and movably coupled to the deck, and a handle assembly having at least a handle pivotally connected to the support post. If desired, a handle linkage can be coupled to the handle, and a lifting device can be coupled between the base bracket and the handle linkage for moving the handle toward the support post when the deck is being moved from the use position to the stored position. Preferably, the handle is substantially parallel with the deck when the deck is in the stored position.

In one embodiment, the lifting device includes a support rod coupled to the support post and a deck rod coupled between the base bracket and the support rod. In this embodiment, the support rod has a first portion slidably coupled to the deck (e.g., in a sliding slot mounted to the deck) and another portion coupled to the handle linkage, such that moving the deck between a use position and a stored position causes the handle to move between a use position and a stored position.

The treadmill can further include a control panel movably coupled to the top portion of the support post. Preferably, a link bar is coupled between the control panel and the handle for moving the control panel when the deck is being moved from the use position to the stored position. For example, the control panel can be substantially parallel with the deck when the deck is in the stored position.

The treadmill can further include a secondary link pivotally coupled to the base bracket at a first pivot axis, the secondary link also pivotally coupled to the deck at a parallel second pivot axis. In this embodiment, the height of the second pivot axis relative to the floor may be different than the height of the first pivot axis relative to the floor.

Independent features and independent aspects of the invention will become apparent to those skilled in the art upon review of the following detailed description, claims, and drawings, wherein like elements have like numerals throughout the drawings.

Figure 1:
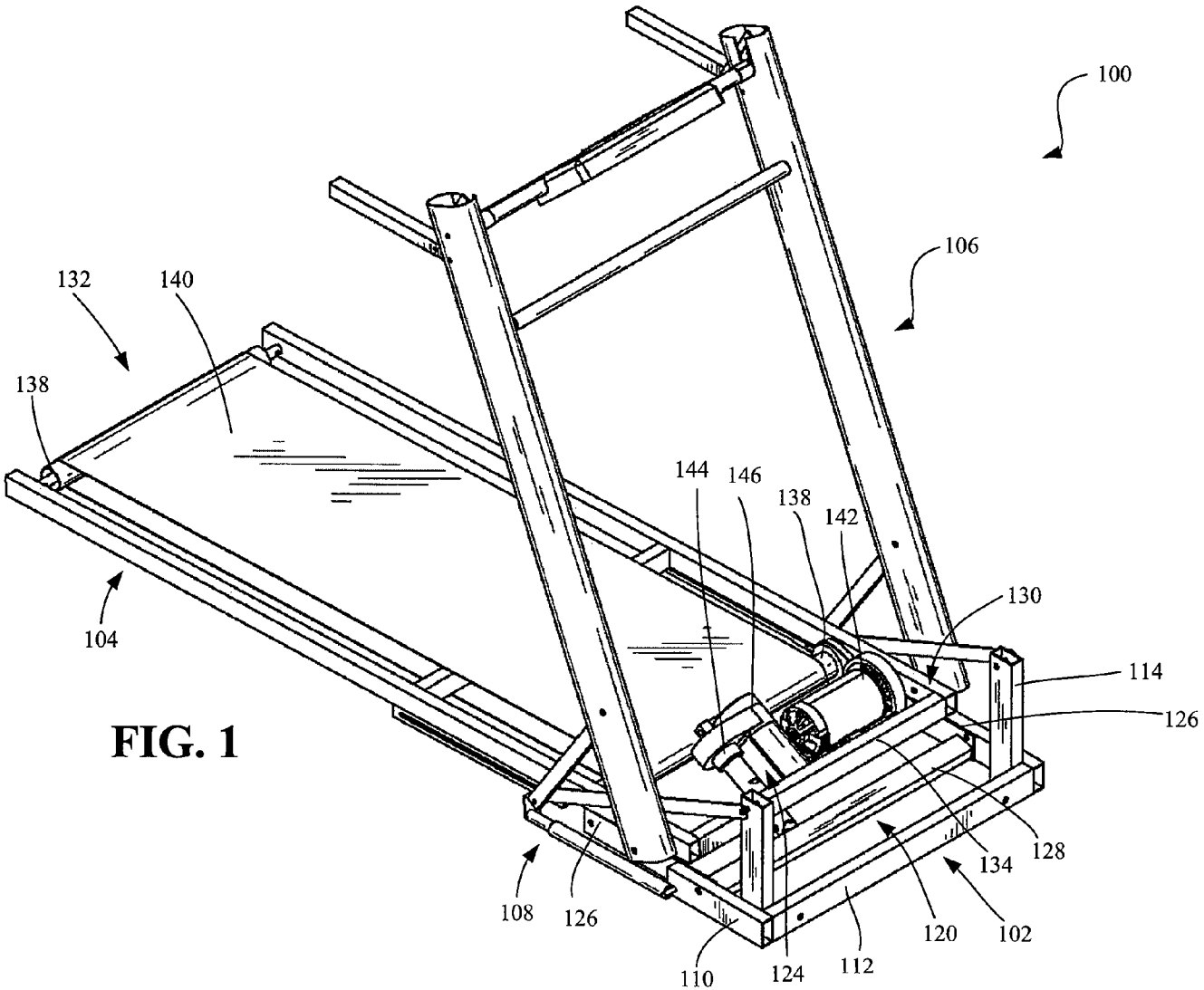
FIG. 1 is a front perspective view of the treadmill and illustrating an unfolded or use condition.

Before at least one independent embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

The use of "including", "having", and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIGS. 1-11 illustrate a folding treadmill 100. The treadmill 100 is movable between an unfolded or use condition (FIGS. 1-7) and a folded or stored condition (FIGS. 8-11). FIGS. 1-7 illustrate the unfolded or use condition of the treadmill 100 in which a user may stand on the exercise surface E provided by the treadmill 100 for walking, running or other exercise.

The treadmill 100 generally includes (see FIG. 1) a base bracket 102, a deck 104 pivotably mounted on the base bracket 102, a mast or control panel support 106 pivotably mounted on a front end of the deck 104, and a lifting device 108 for folding and/or unfolding the treadmill 100.

The base bracket 102 includes two side bracket bars 110, a cross bracket bar 112 connecting the side bracket bars 110, two bracket supports 114 extending upward from the respective side bracket bars 110. In the example illustrated in FIG. 2, the base bracket 102 is mounted on a wall W of an exercise area such as, for example, a wall of the exercise room, the user's home, and is supported on a surface S such as, for example, a floor surface in the exercise area. In should be understood that the base bracket could be supported by the wall alone, and not the floor surface, or may be mounted onto a floor surface instead of a wall.

Figure 8:
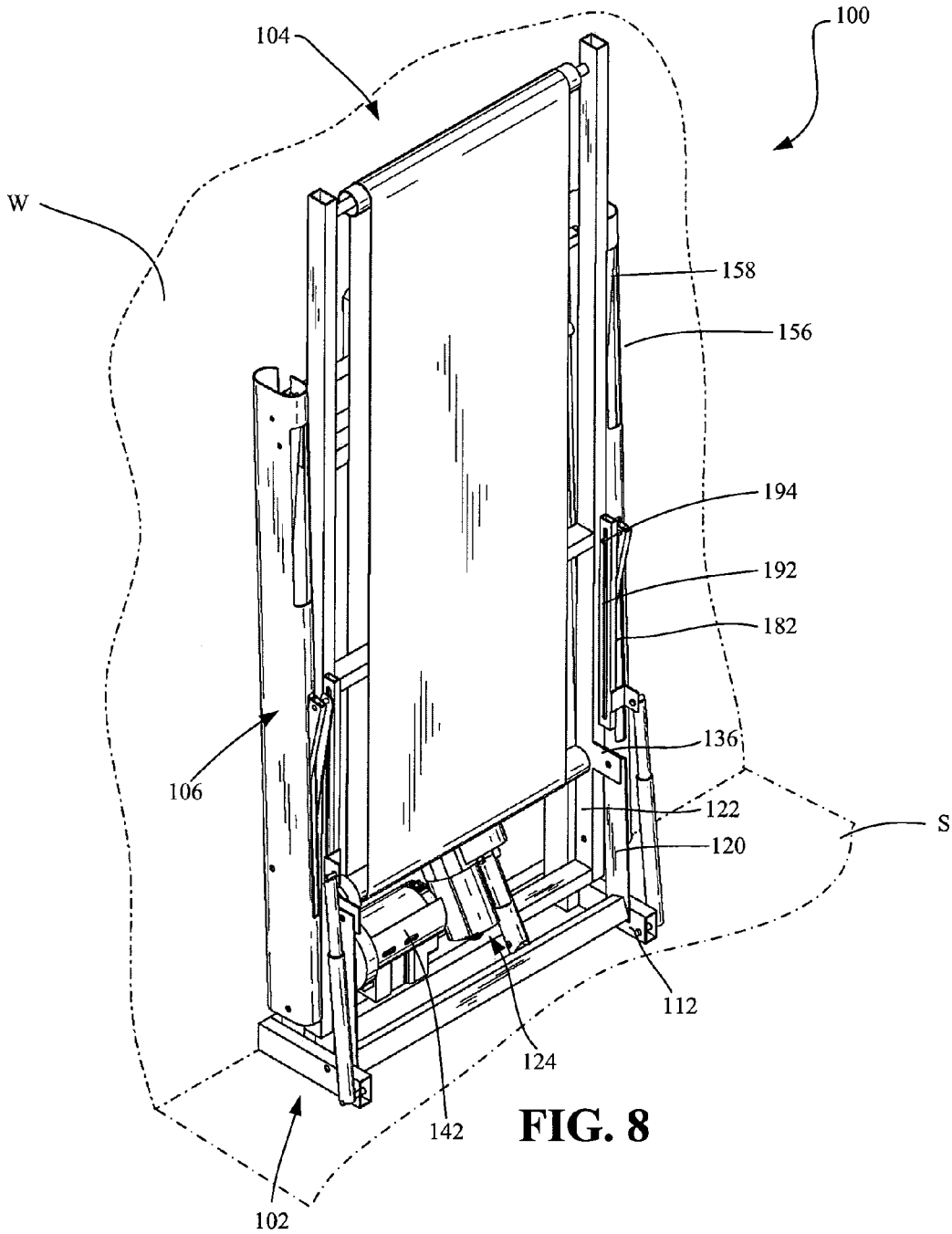
FIG. 8 is a rear perspective view of a treadmill shown in FIG. 1 and illustrating a folded or stored condition.

In the illustrated construction, the deck 104 is substantially supported on the surface S in the use condition. The deck 104 generally includes a lower frame 120, an upper frame 122, and an incline or elevating device 124 for adjusting the incline angle of the upper frame 122 and of the exercise surface E. The lower frame 120 is U-shaped and includes two lower side bars 126 and a lower cross bar 128 connecting the front ends of the lower side bars 126. The front ends of the lower side bars 126 are pivotably connected to the respective side bracket bars 110. The rear ends of the lower side bars 126 are rotatably connected with two respective sides of the upper frame 122. Therefore, the lower frame 120 is pivotably connected with the base bracket 102 and rotatably supports the upper frame 122 (as also illustrated in FIG. 8).

Figure 2:
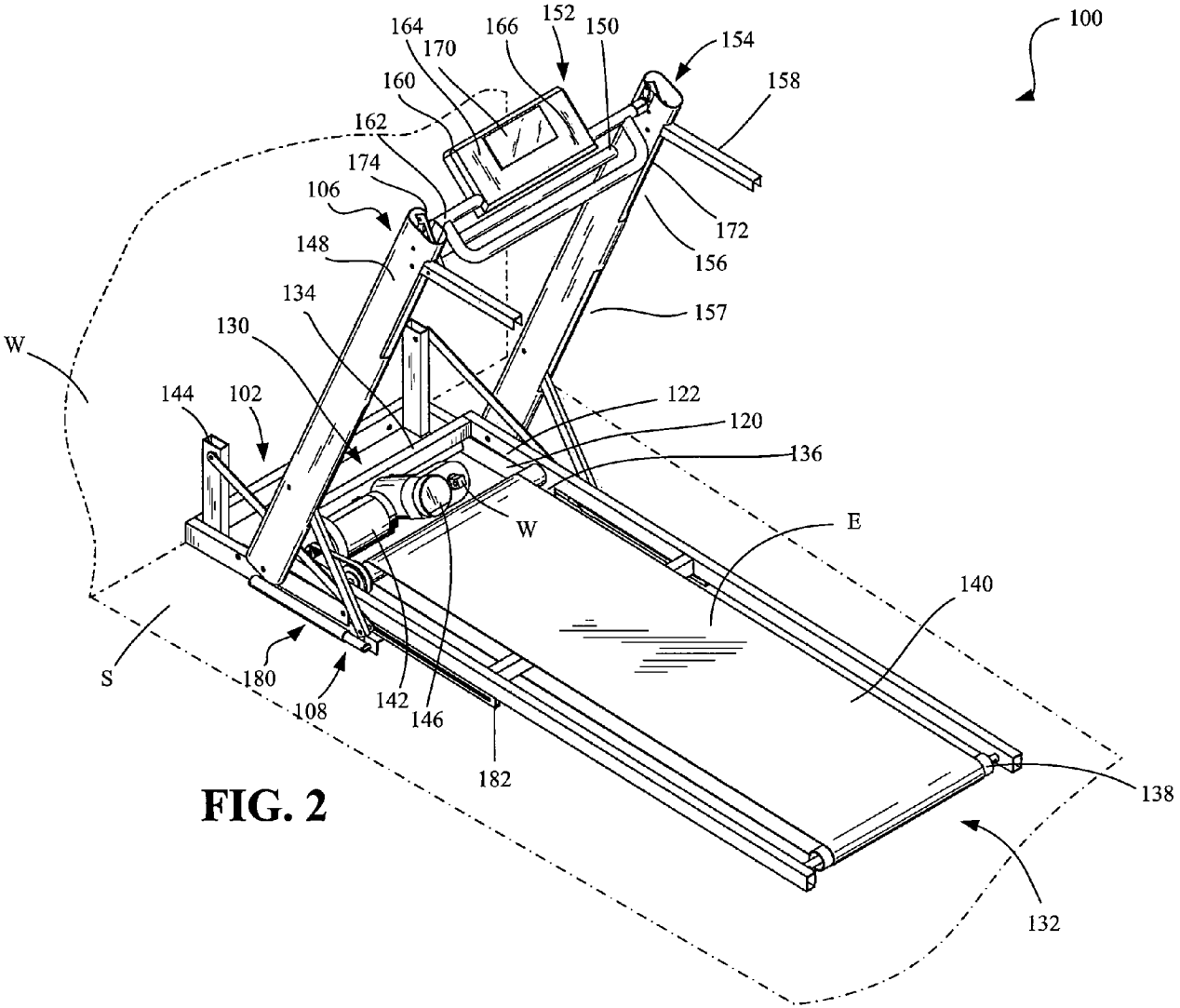
FIG. 2 is a rear perspective view of the treadmill shown in FIG. 1.
Figure 3:
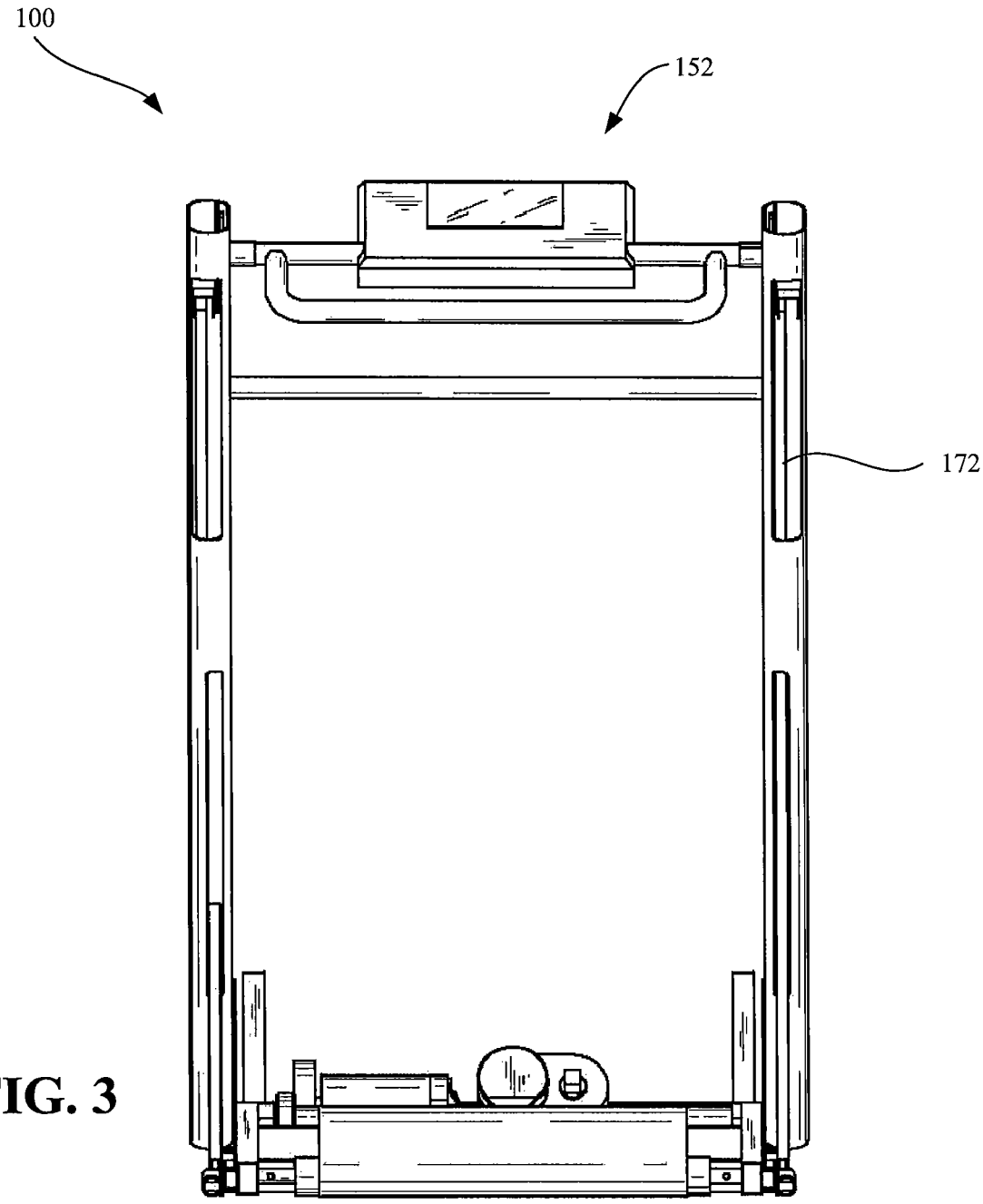
FIG. 3 is a rear view of the treadmill shown in FIG. 1.

The upper frame 122 includes a front end 130, a rear end 132, a front cross bar 134, and two protrusions 136 (shown in FIGS. 2 and 8) extending downwardly to pivotably connect with the lower frame 120. As shown in FIG. 2, the upper frame 122 also includes two rollers 138 respectively positioned adjacent the front end 130 and the rear end 132, an endless belt 140 suspended on the rollers 138 and providing the exercise surface E and a drive motor 142 drivingly coupled to at least one roller 138. The drive motor 142 may be energized to rotate the roller 138 and the endless belt 140 to facilitate walking, running, etc. on the endless belt 140 and exercise surface E at a selected speed.

The incline or elevating device 124 includes a screw rod 144 and an incline or elevating motor 146 drivingly coupled with the screw rod 144. The screw rod 144 is pivotally connected with the lower cross bar 128 of the lower frame 120, and the elevating motor 146 is pivotally mounted on the front cross bar 134 of the upper frame 122. The screw rod 144 defines a distance between the upper frame 122 and the lower frame 120, and, therefore, the elevating motor 146 is operable to rotate the screw rod 144 to increase or decrease the distance between the upper frame 122 and the lower frame 120 to thereby adjust the incline angle of the exercise surface E.

In the example illustrated in FIG. 2, when the screw rod 144 is retracted to decrease the distance, the upper frame 122 generally lies on the lower frame 120. When the screw rod 144 is extended to increase the distance between the upper frame 122 and the lower frame 120, the front end 130 of the upper frame 122 moves upwardly while the rear end 132 of the upper frame 122 is substantially supported on the surface S. Therefore, the elevating device 124 is operable to adjust the incline angle of the upper frame 122, i.e. the incline angle of the endless belt 140 and the exercise surface E according to the user's selection or operation. It should be understood that other known mechanisms could also be used to adjust the height of the front end of the upper frame 122 and/or the incline angle of the exercise surface E.

Figure 5:
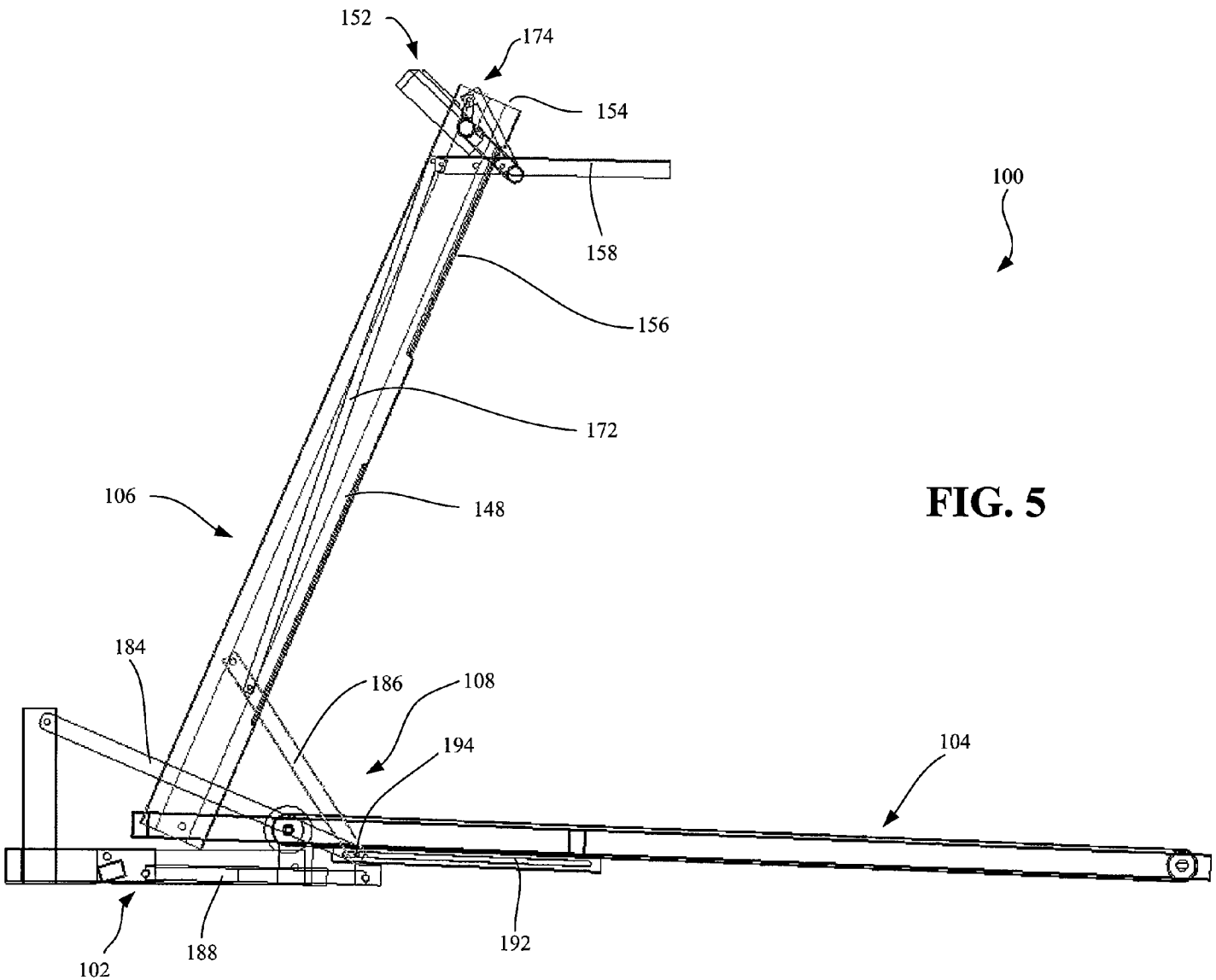
FIG. 5 is a side cross-sectional view of the treadmill shown in FIG. 1.

As shown in FIGS. 2 and 5, the control panel support 106 is positioned at a use position such as, for example, the illustrated angled position, in the use condition of the treadmill 100. The control panel support 106 generally includes two support posts 148, a support bar 150 connecting the support posts 148 and a control panel assembly 152 pivotably supported on two upper ends of the support posts 148.

In the illustrated construction, the support posts 148 are pivotably connected with the front end 130 of the upper frame 122. Each support post 148 generally includes a central opening 154 defined along a longitudinal axis thereof, a handle receiving slot 156, and a linkage receiving slot 157. The handle receiving slots 156 and the linkage receiving slots 157 are defined in communication with the central opening 154.

A handle 158 is pivotally mounted on each support post 148 and is extendable outwardly from the handle receiving slots 156. The support posts 148 and the handles 158 are moved to the use position by operation of the lifting device 108 in positioning the treadmill 100 in the use condition, as explained below in more detail.

The control panel assembly 152 includes a panel 160 fixed on a panel bar 162. The panel bar 162 is pivotably connected to the support posts 148 so that the panel 160 may be rotated to a use position such as, for example, a substantially horizontal or inclined position, in the use condition of the treadmill 100. It should be understood that the panel 160 could be pivotably mounted on the panel bar 162 manually for further adjustment of the position. The treadmill 100 also includes a controller 164, and the panel 160 provides an input interface 166 having a plurality of input selectors (not shown) and at least one display 170 disposed thereon. The controller 164 is in signal communication with the input interface 166 for receiving the operation and/or selection of treadmill features from a user. The controller 164 is operatively coupled to the display 170 for providing the user with the operating status and/or the selected features of the treadmill 100.

It should be understood that the controller 164 is coupled to the drive motor 142 and/or the elevating device 124 for controlling a moving speed of the endless belt 140 and the incline angle of the exercise surface E, respectively. It should also be understood that the controller 164 may also be coupled to the lifting device 108 and other treadmill components to control the folding/unfolding process and other treadmill operations.

Figure 6:
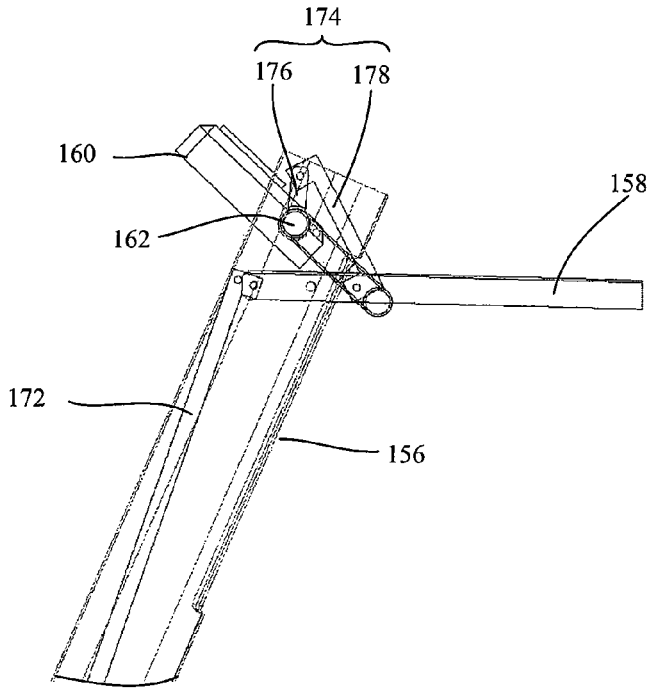
FIG. 6 is an enlarged view of an upper portion of the treadmill shown in FIG. 5
Figure 7:
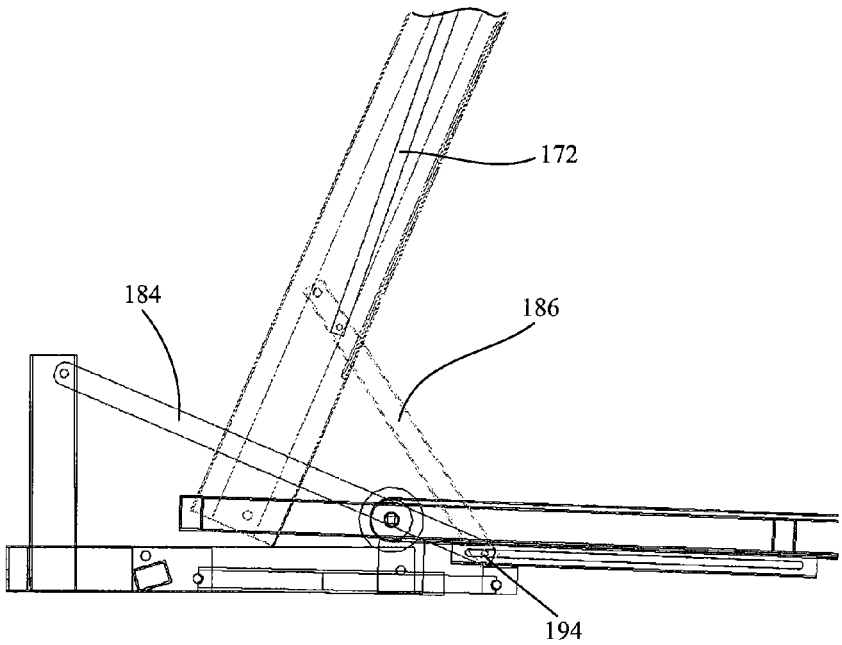
FIG. 7 is an enlarged view of a lower portion of the treadmill shown in FIG. 5.

As shown in FIGS. 5 and 6, the control panel support 106 also includes two handle linkages 172 for moving the handles 158, and two control panel linkages 174 for moving the control panel assembly 152 during the folding/unfolding process. The handle linkage 172 and the control panel linkage 174 are substantially received within the central opening 154 and coupled with the handle 158 and the panel bar 162, respectively.

The handle linkages 172 connect the inner end of the handle 158 and the lifting device 108 and transfer movement of the lifting device 108 to pivot the handle 158 outwardly from the handle receiving slot 156 during the unfolding process and inwardly into the corresponding handle receiving slot 156 during the folding process.

The control panel linkage 174 further includes a pivoting bar 176 fixed on the end of the panel bar 162 for pivoting of the control panel assembly 152, and a link bar 178 pivotably connecting the pivoting bar 176 and the handle 158. When the handle 158 pivots, the link bar 178 drives the pivoting bar 176 to pivot together with the panel bar 162, and the control panel linkages 174 coordinate the movement of the handles 158 to pivot the control panel assembly 152 to its use position during the unfolding process and to its stored position during the folding process.

It should be understood that the handle linkage 172 and the control panel linkage 174 on the same support post could be driven by another mechanism or separate mechanisms (not shown) positioned within the support post 148. It should also be understood that, in other constructions (not shown), the linkages 172 and/or 174 may include mechanisms such as, for example, rods, gears, cams, and/or springs which independently or cooperatively move the handle(s) 158 and/or control panel 160 to a predetermined position in the folding/unfolding process.

Figure 4:
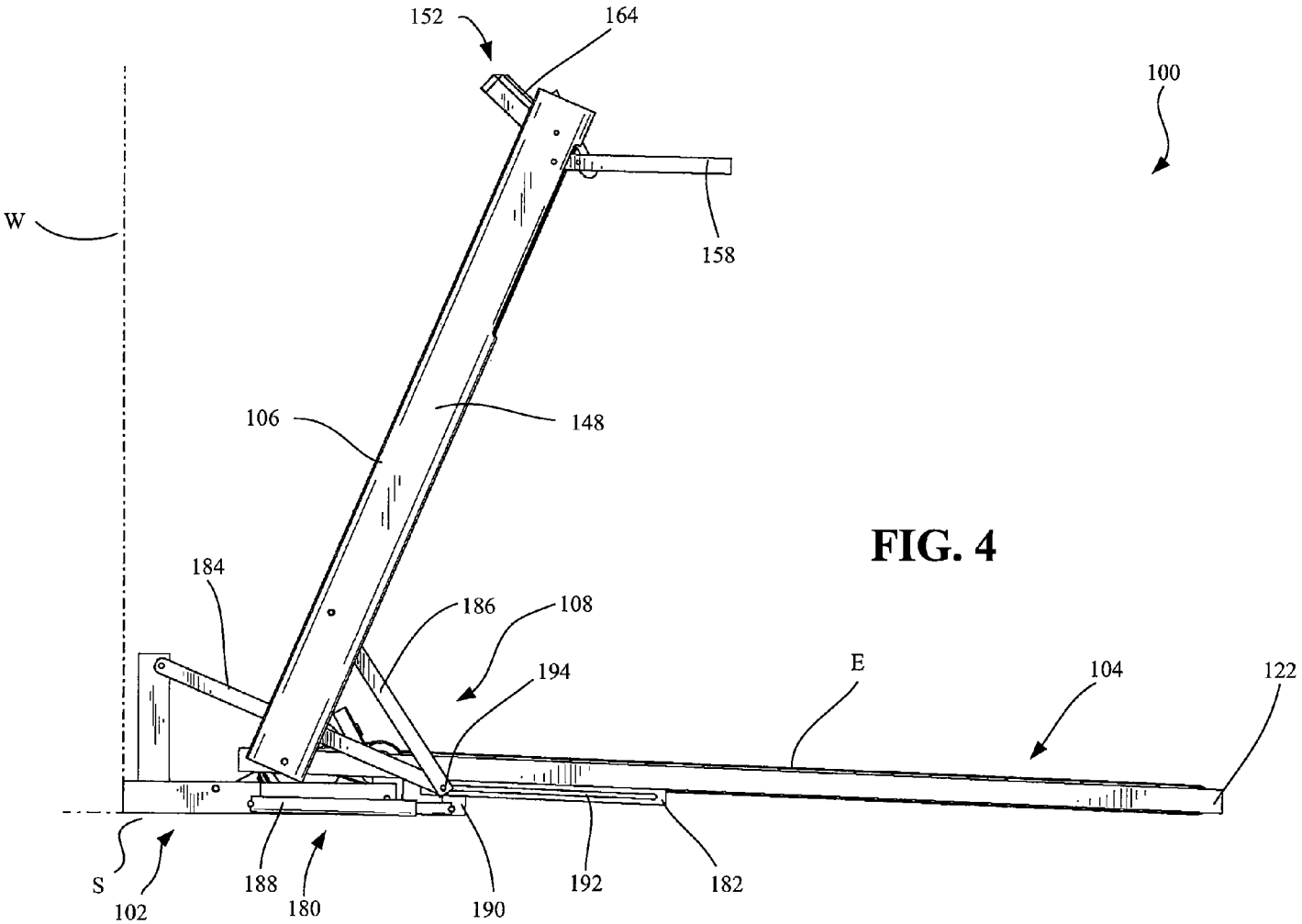
FIG. 4 is a side view of the treadmill shown in FIG. 1.

As shown in FIGS. 2 and 4, the lifting device 108 includes a pair of lifting linkages 180 positioned at two sides of the base bracket 102. Each lifting linkage 180 includes a lifting base 182 positioned on an underside of the upper frame 122 of the deck 106, a deck rod 184, a support rod 186, and a piston/cylinder assembly 188. The lifting base 182 includes a base protrusion 190 fixed thereon, a sliding slot 192 defined along the longitudinal direction of the deck 104, and a slider 194 movable along the sliding slot 192. The deck rod 184 pivotably connects the slider 194 and the bracket supports 114 of the base bracket 102. The support rod 186 pivotably connects the control panel support 106 and the slider 194 and is pivotably connected with the lower end of the handle linkage 172 for drivingly moving the handle linkage 172 and, in turn, the corresponding handle 158 during the folding/unfolding process. The piston/cylinder assembly 188 pivotably connects the base bracket 102 and the base protrusion 190 of the lifting base 182. In some constructions, the lifting device 108, (e.g., the piston/cylinder assembly 188) may be operated by the controller 164 to perform the folding/unfolding process.

It should be understood that other known mechanisms such as, for example, rods, gears, cams, springs and/or different type of linkages may independently or cooperatively employed as a substitute for the lifting mechanism 108. It should also be understood that the piston/cylinder assembly 188 could be any known mechanism such as, for example, hydraulic pressure units, air pressure units and/or screw rods.

FIGS. 8-11 illustrate the folded or stored condition of the treadmill 100. The deck 104 is pivoted and is maintained in a folded or stored position such as, for example, a substantially vertical or inclined position. In the illustrated construction, the upper frame 122 and the lower frame 120 are pivoted upwardly to be substantially parallel to the wall to which the base bracket 102 is mounted. The drive motor 142 and the elevating device 124 are also moved to a raised position in the stored condition.

In the illustrated example, before folding, the elevating device 124 should be operated to lower the deck 104 to facilitate the folding process. It should be understood that the controller 164 could automatically operate the elevating device 124 to lower the deck before initiating the folding process.

Figure 9:
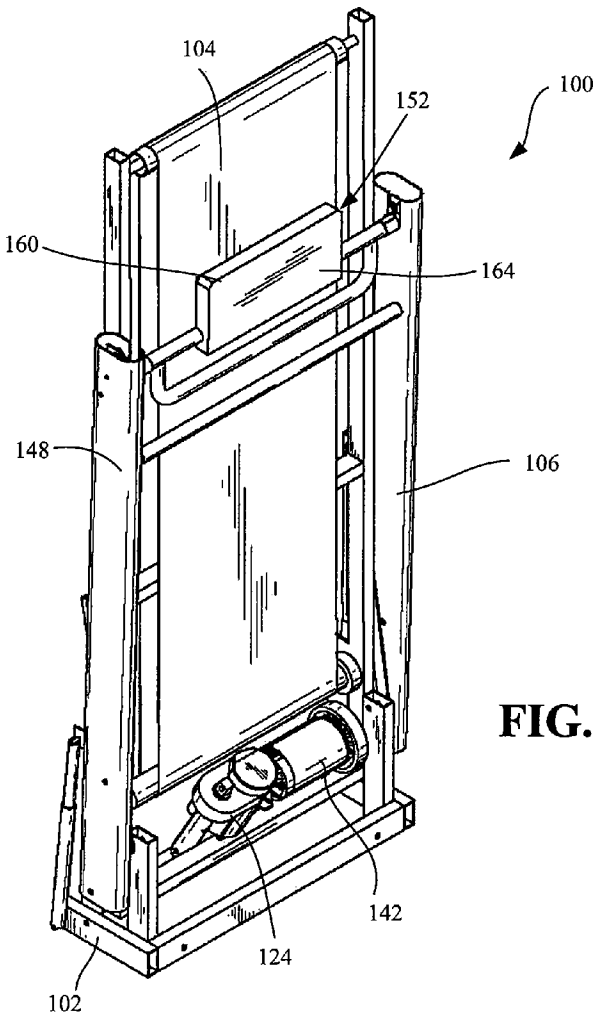
FIG. 9 is a front perspective view of the treadmill shown in FIG. 8.
Figure 10:
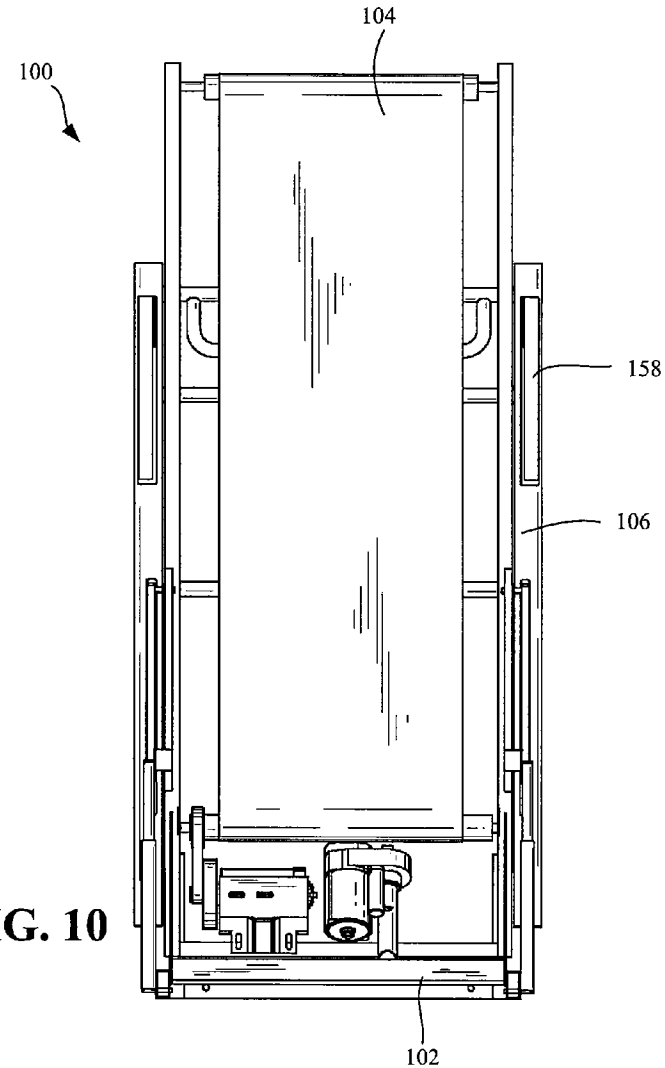
FIG. 10 is a rear view of the treadmill shown in FIG. 8.

The handles 158 are positioned in a substantially vertical or inclined position and, in the illustrated construction, are substantially received within the corresponding handle receiving slot 156 in the stored condition. It should be understood that, in other constructions (not shown), handle receiving slots 156 may not be provided in the support posts 148, and, in such constructions, the handles 158 would be positioned adjacent to and/or overlaying the corresponding support posts 148 in the stored condition. As shown in FIG. 9, the control panel assembly 152 is also moved to a substantially vertical or inclined position. The panel 160 and the support posts 148 of the control panel support 106 are then substantially parallel to the deck 104.

Referring back to FIGS. 1-2, during the exercise, the user may stand on the exercise surface E provided by the endless belt 140 for walking, running or other exercise. In the illustrated embodiment, the user may adjust the incline angle of the deck 104 and the exercise surface E through the input interface 166 on the control panel assembly 152. The user may also adjust the moving speed of the endless belt 140 through the input interface 166. The operational status such as, for example, the speed of the endless belt 140, the incline angle of the exercise surface and/or the elapsed time may be displayed on the display 170 of the control panel assembly 152.

Referring back to FIGS. 2 and 4-10, after the exercise, the user may instruct through the input interface 166 or another selector (not shown) disposed on the outer surface of the treadmill 100 to automatically fold the treadmill 100. The piston/cylinder assembly 188 of the lifting device 108 is operated (e.g., by the controller 164) to the extended position, and the deck 104 is pivoted toward the stored position. During the folding process, the deck rod 184 limits the position of the slider 194 within the sliding slot 192, and the slider 194 moves toward a rear end of the sliding slot 192 during the folding process. The support rod 186 then pivots toward the support post 148 and pushes the control panel support 106 to pivot toward the stored position.

The support rod 186 and the handle 158 are pivotally mounted on the support post 148, and the handle linkage 172 pivotably connects the support rod 186 and the handle 158. The handle linkage 172 transfers pivoting movement of the support rod 186 to pivot the handle 158 toward the handle receiving slot 158. The link bar 178 also pulls the pivoting bar 176 to pivot toward the stored position together with the panel bar 162 when the handle 158 pivots toward the handle receiving slot 158. Therefore, the handle linkage 172 and the control panel linkage 174 coordinate the movement of the deck 104 to pivot the handle 158 and the control panel assembly 152 to the predetermined stored position.

In the illustrated construction, the treadmill 100 is maintained in the stored condition by the lifting device 108 without additional latching or locking mechanisms to lock the treadmill components. It should be understood that, in other constructions, additional or auxiliary locking structure may be provided to cooperate in maintaining the treadmill 100 in the stored condition.

In the fully folded condition of the treadmill 100, the deck 104, the control panel support 106, the handles 158 and the control panel assembly 152 are positioned within the depth of the base bracket 102, i.e., within the length of the side bracket bars 110. Therefore, a considerable amount of space on the surface S and in the room is available after the folding process.

It should be understood that the deck 104 could be positioned at a direction other than the vertical direction in the stored condition, such as, for example, an inclined direction. It should also be understood that at least two of the deck 104, the handles 158, the control panel assembly 152 and the control panel support 106 could be positioned at least adjacent to each other in the stored condition, which facilitates saving the storage space in the exercise area.

Referring back to FIGS. 2, and 5-9, when a user wants to exercise, the user may cause the treadmill 100 to automatically unfold. It is understood that the unfolding instruction may be input by pressing a selector (not shown) disposed on the outer surface of the treadmill 100, such as on the side or on the undersurface of the deck 104, or by inputting the instruction through a remote controller (not shown). The piston/cylinder assembly 188 of the lifting device 108 is operated (e.g., by the controller 164) to the retracted position, and the deck 104 is pivoted toward the surface S.

The deck rod 184 limits the position of the slider 194 within the sliding slot 192, and the slider 194 moves toward the front end of the sliding slot 192 during the unfolding process. The support rods 186 pivot toward the surface S and pull the control panel support 106 to pivot to the use position such as, for example, an inclined position. The handle linkages 172 drive the handles 158 to pivot outwardly from the handle receiving slots 156 when the corresponding support rods 186 pivot outwardly. The link bar 178 also cooperates with the pivoting bar to pivot the panel bar 162 and the panel 160 toward the use position when the corresponding handle 158 pivots outwardly. Therefore, the handle linkage 172 and the control panel linkage 174 coordinate the movement of the deck 104 to pivot the handles 158 and the control panel assembly 152 to the predetermined use position.

In the fully unfolded condition of the treadmill 100, as shown in FIG. 4, the deck 104, the control panel support 106, the handles 158 and the control panel assembly 152 extend beyond the depth of the base bracket 102, i.e., beyond the length of the side bracket bars 110. The deck 104 is supported on the surface S in the use condition, and the treadmill 100 is ready to be used.

It should be understood that the treadmill 100, the deck 104, the control panel support 106, the handles 158 and the control panel assembly 152 could be movable between the corresponding stored position and the corresponding use position by other mechanical ways such as, for example, sliding. It should also be understood that the position of at least one of the deck 104, the control panel support 106, the handles 158 and the control panel assembly 152 could also be manually adjusted.

Figure 12:
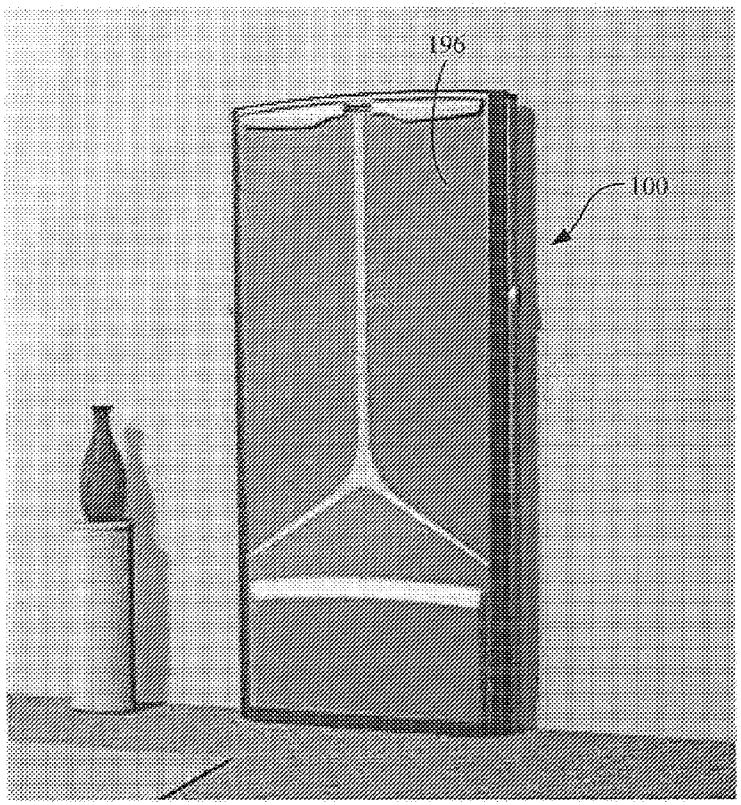
FIG. 12 is a perspective view of a treadmill that is similar to that shown in FIGS. 1-11 and illustrating a folded or stored condition.
Figure 11:
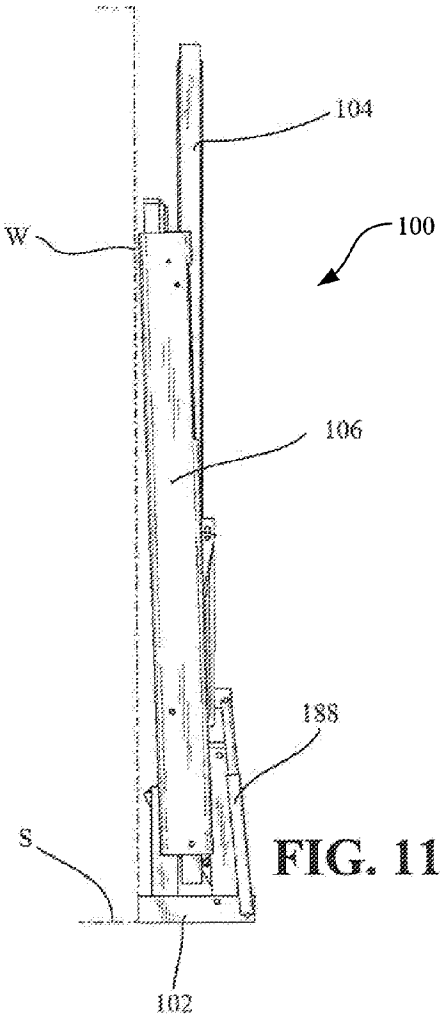
FIG. 11 is a side view of the treadmill shown in FIG. 8.

FIG. 12 illustrates a folding treadmill 100 that is similar to the treadmill 100 shown in FIG. 1-11. In FIG. 12, the treadmill 100 is illustrated in a folded or stored condition. The outwardly-facing bottom portion of the deck includes or is provided with a cover 196 which is visually-appealing. The cover 196 may be designed to match features (e.g., color, shapes, textures, materials, etc.) of the adjacent environment, such as, for example, the wall, floor, furniture, etc. The cover 196 itself may be designed to provide another feature in the workout area, such as, for example, a display/writing surface, storage, mirror, art work, etc. The cover 196 may be fixed to the bottom of the deck or may be removable from the deck (e.g., prior to use, to substitute another different cover, etc.).

FIGS. 13-20 illustrate another folding treadmill 200. The treadmill 200 is similar to the treadmill 100 shown in FIGS. 1-11 and in FIG. 12. The treadmill 200 is movable between an unfolded or use condition (FIGS. 13-16) and a folded or stored condition (FIGS. 17-20) by manual operation (in the illustrated construction). The treadmill 200 generally includes (see FIG. 13) a base bracket 202, a deck 204 pivotably mounted on the base bracket 202, a mast or control panel support 206 pivotably mounted on the base bracket 202 at the same pivot as the deck 204.

It should be understood that, in other constructions (not shown), the control panel support 206 could be pivotably mounted on the front end of the deck 204 instead of on the base bracket 202. It should also be understood that the control panel support 206 could be pivotably mounted on a pivot different than the pivot of the deck 204.

Figure 13:
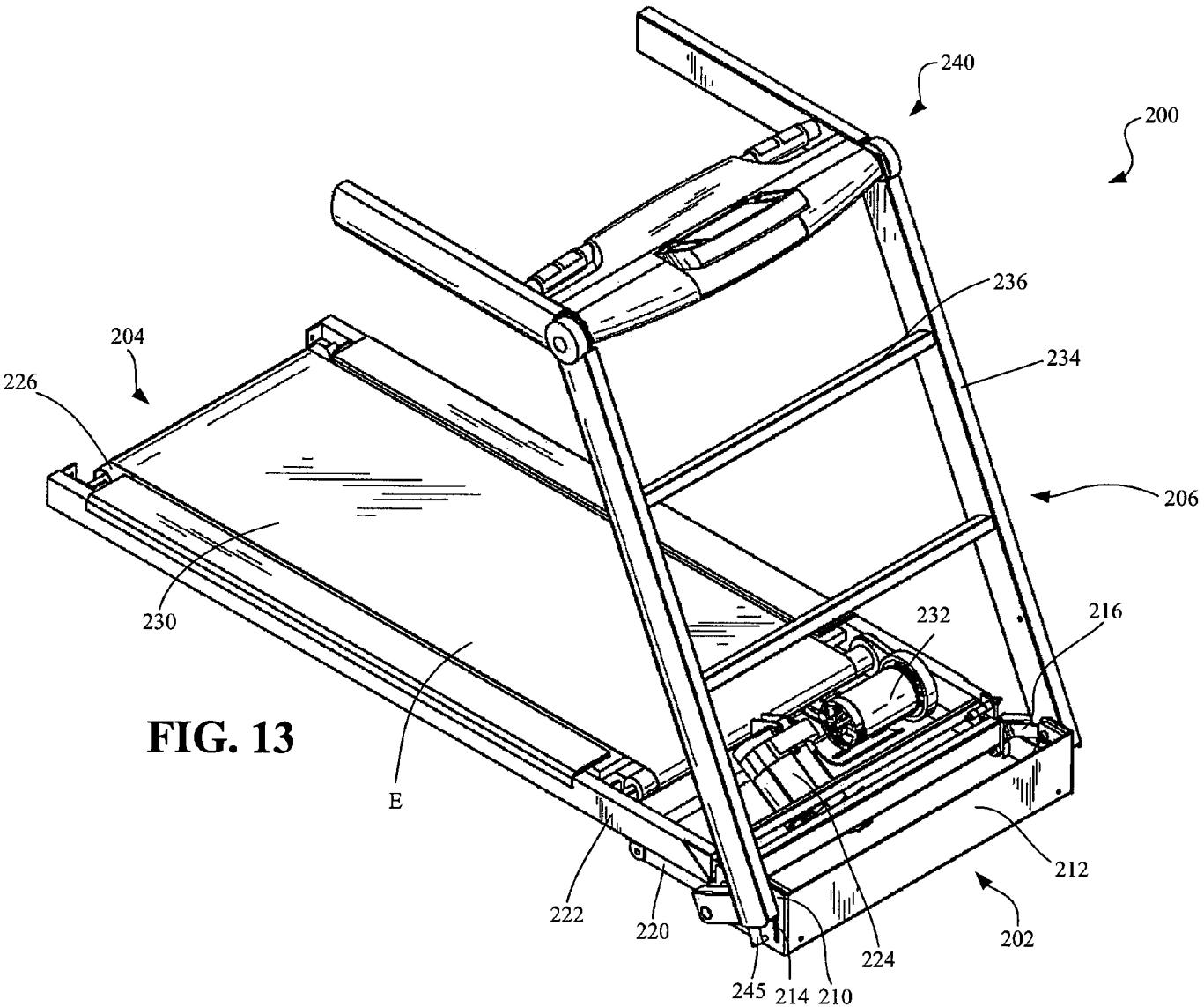
FIG. 13 is a front perspective view of another treadmill and illustrating an unfolded or use condition.

FIGS. 13-16 illustrate the unfolded or use condition of the treadmill 200 in which a user may stand on the exercise surface E provided by the treadmill 200 for walking, running or other exercises. As shown in FIG. 13, the base bracket 202 is mounted on a wall W and supported on a surface S in a similar way as the base bracket 102 shown in FIGS. 2 and 8. It should be understood that the base bracket could be supported by the wall alone, and not the floor surface, or could be mounted onto a floor surface instead of a wall. As shown in FIG. 13, the base bracket 202 generally includes two side walls 210 and a front wall 212 connecting the side walls 210. Each side wall 210 generally includes an arcuate sliding slot 214 defined therethrough, facilitating the pivoting of the control panel support 206. It should be understood that a linkage could be positioned on the side wall for coordinating the movement of the deck 204 and the control panel support 206 during the folding/unfolding process.

In the illustrated construction, the deck 204 is substantially supported on the surface S in the use condition. The deck 204 generally includes a lower frame 220 pivotably connected with the base bracket 202, an upper frame 222 pivotably connected with the lower frame 220, and an incline or elevating device 224 for adjusting the incline angle of the upper frame 222 in a similar way as the elevating device 124 shown in FIGS. 1-2.

As shown in FIG. 13, the upper frame 222 includes two rollers 226 respectively positioned on opposite ends thereof, an endless belt 230 suspended on the rollers 226 and providing an exercise surface and a drive motor 232 for rotating the roller 226, the endless belt 230 and the exercise surface E at a selected speed.

Figure 14:
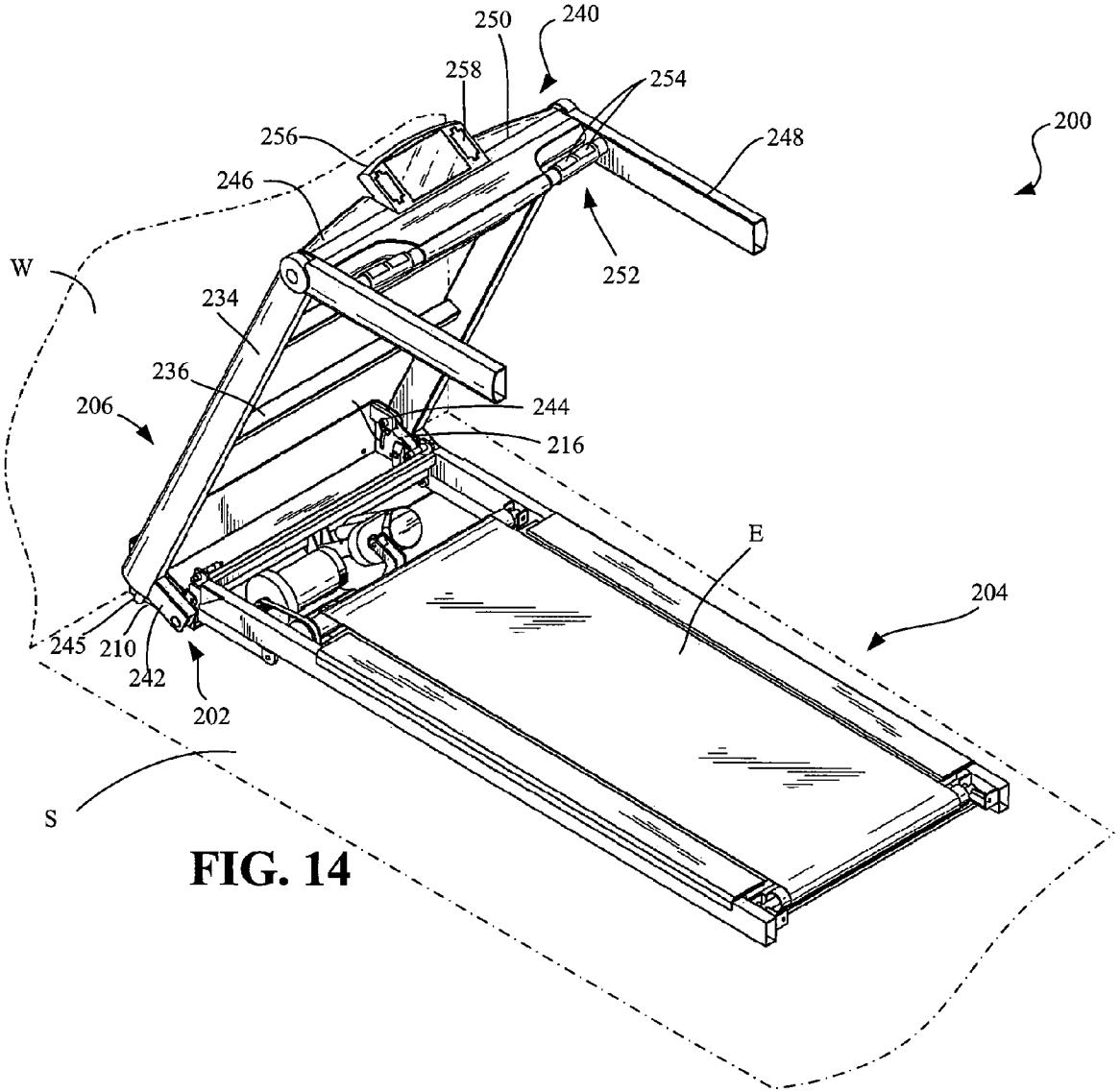
FIG. 14 is a rear perspective view of the treadmill shown in FIG. 13.
Figure 15:
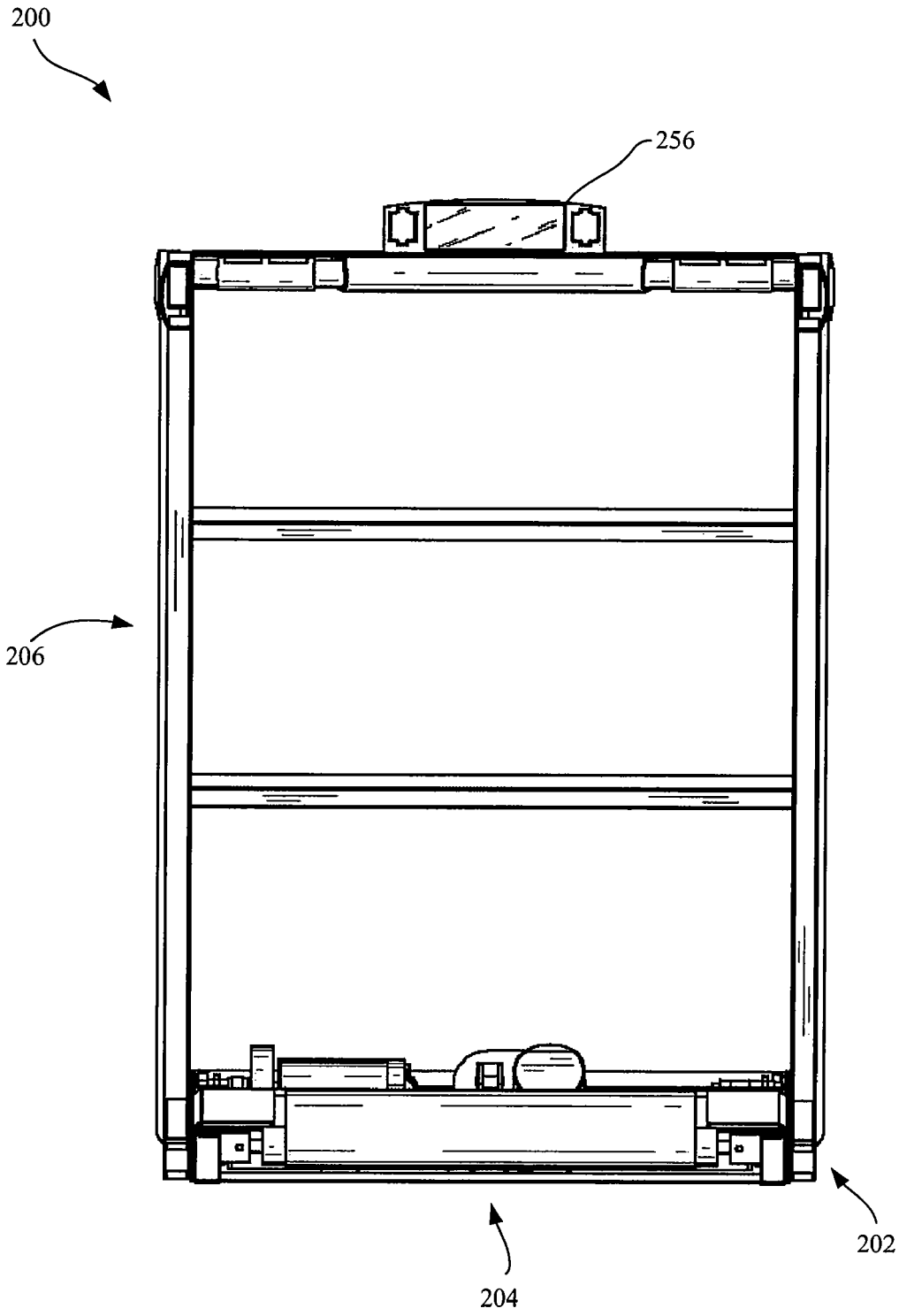
FIG. 15 is a rear view of the treadmill shown in FIG. 13.
Figure 16:
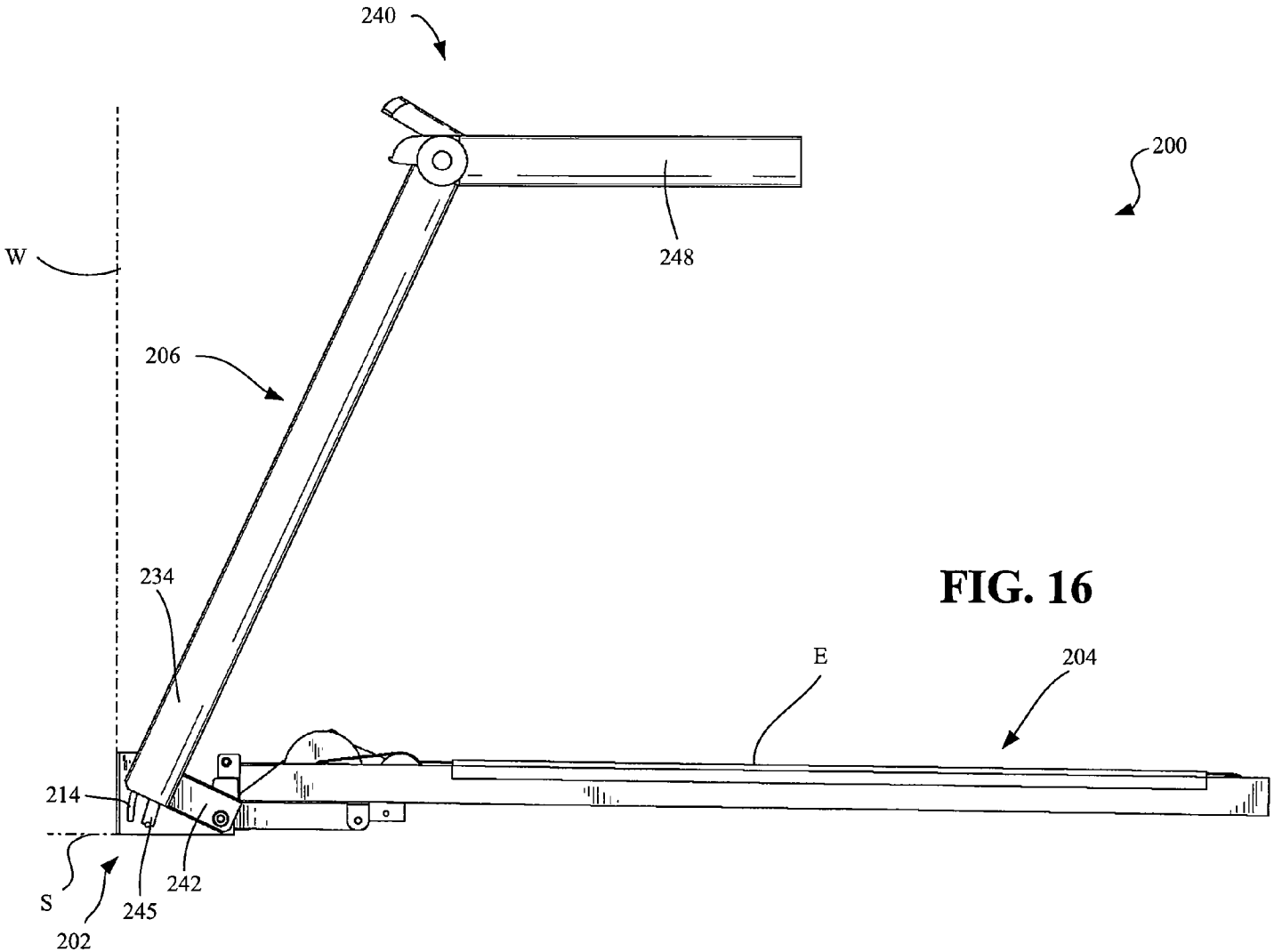
FIG. 16 is a side view of the treadmill shown in FIG. 13.
Figure 17:
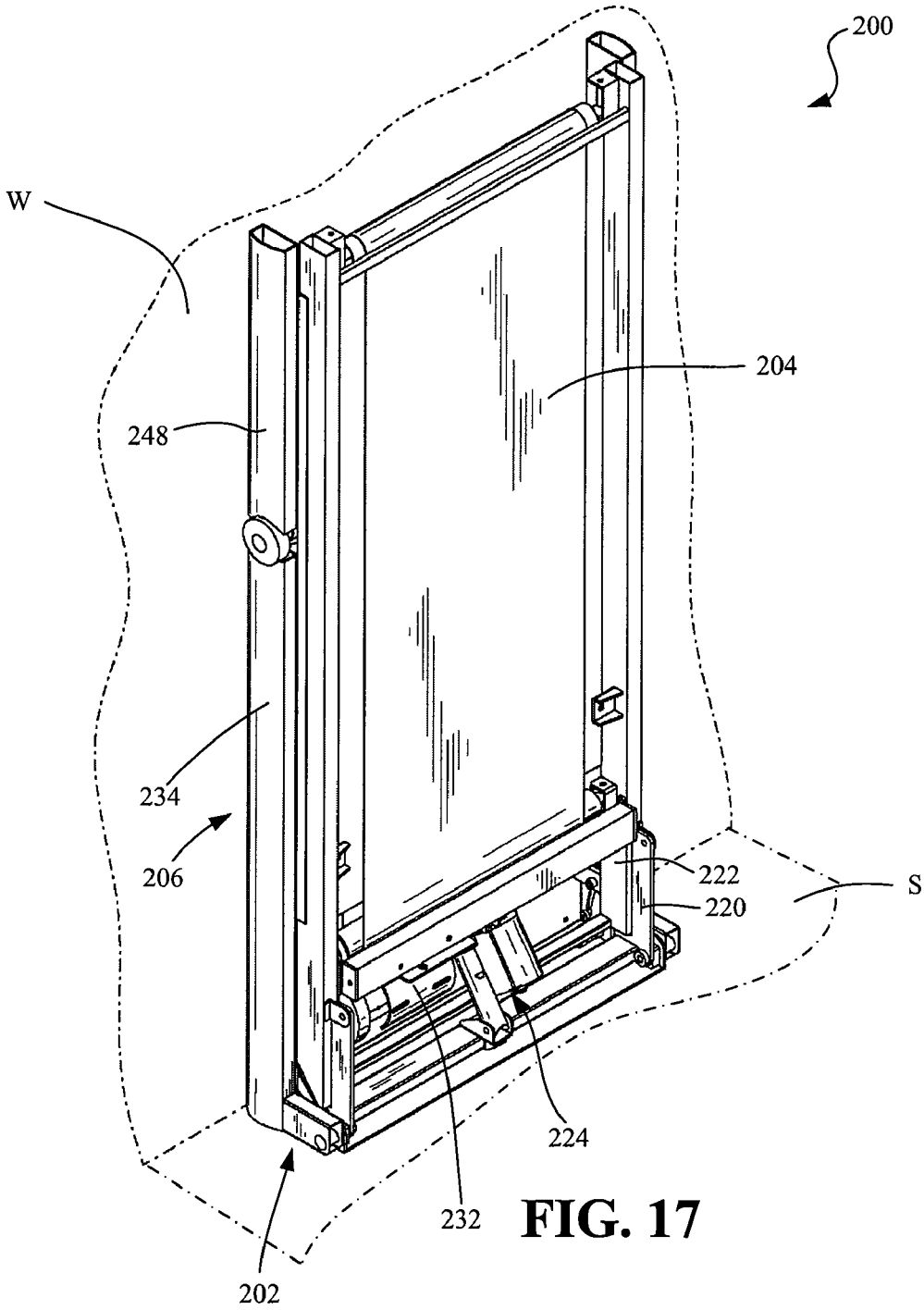
FIG. 17 is a rear perspective view of a treadmill shown in FIG. 13 and illustrating a folded or stored condition.

As shown in FIG. 14, the control panel support 206 is positioned at a use position such as, for example, an inclined position, in the use condition of the treadmill 200. The control panel support 206 generally includes two support posts 234, a plurality of support bars 236 connecting the support posts 234 and a control panel assembly 240 pivotably supported on two upper ends of the support posts 234. Each support post 234 includes a lower end 242 pivotably connected with the corresponding side wall 210 of the base bracket 202, a slider 244 and an elastic member 245 such as, for example, a spring, disposed on the lower end 242. The slider 244 is movably inserted into the sliding slot 214 to limit the pivoting angle of the support post 234. The elastic member 245 abuts the lower end 242 to bias the support post 234 toward the use position.

The control panel assembly 240 generally includes a panel 246 connected with two handles 248 at opposite sides thereof. The panel 246 is manually pivoted together with the handles 248 to a use position such as, for example, a substantially horizontal or inclined position, in the use condition of the treadmill 200. It should be understood that, in other constructions, the handles 248 could be pivotably connected with the panel.

The treadmill 200 includes a controller 250, and the panel 246 includes at least one input interface 252 having a plurality of input selectors 254 and a display panel 256 pivotably disposed thereon. The display panel 256 further includes two speakers 258 disposed on opposite sides thereof for acoustically prompting the user or broadcasting some music to entertain the user. The display panel 256 is pivoted to a use position such as, for example, an inclined position in the use condition of the treadmill 200. The display panel 256 may be further positionable as a user prefers. It should be understood that, the display panel 256 could be manually or automatically pivoted between the use position and the stored position.

The controller 250 is in signal communication with the input interface 252/the display panel 256 for receiving/displaying the operational information from/to the user. The controller 250 is also coupled to the drive motor 232, the elevating device 224 and other treadmill components for controlling the moving speed of the endless belt 230, the incline angle of the exercise surface E and other treadmill operations, respectively.

FIGS. 17-20 illustrate the folded or stored condition of the treadmill 200. In the illustrated construction, the deck 204 is manually pivoted to and is maintained in the folded or stored position such as, for example, a substantially vertical or inclined position. In the illustrated construction, the upper frame 222 and the lower frame 220 are pivoted upwardly to be substantially parallel to the wall W to which the base bracket 202 is mounted. The drive motor 232 and the elevating device 224 are also moved to a raised position in the stored condition.

It should be understood that, in other constructions (not shown), the drive motor 232 could be stationary on the treadmill 200, for example, fixed on the wall W or on the base bracket 202. In such constructions, the deck 204 could be pivotable substantially around the front roller 226 between the stored position and the use position with the drive motor 232 remaining fixed in position during the folding/unfolding process.

Figure 18:
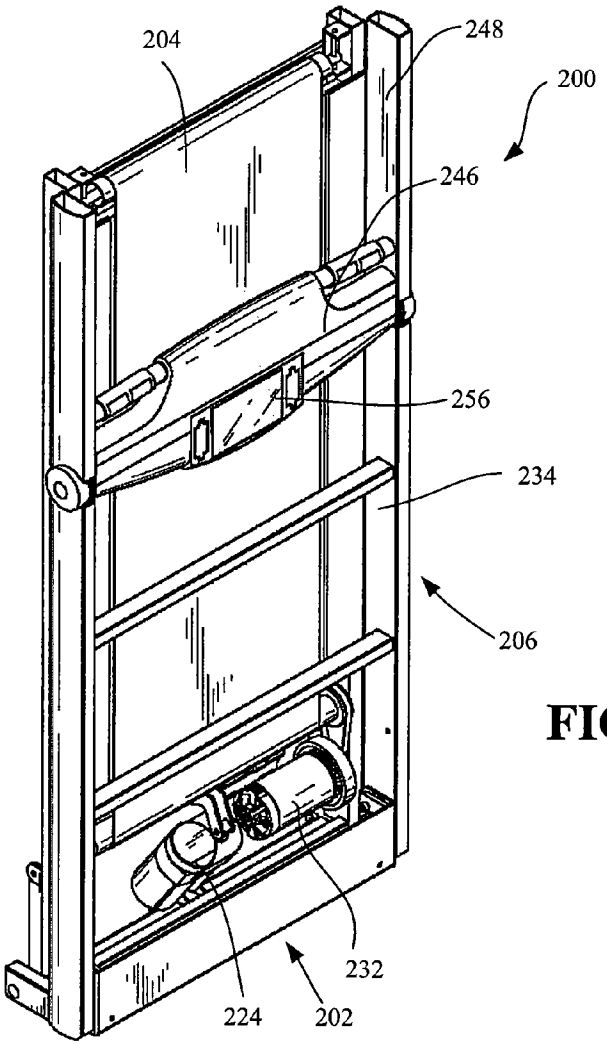
FIG. 18 is a front perspective view of the treadmill shown in FIG. 17.
Figure 19:
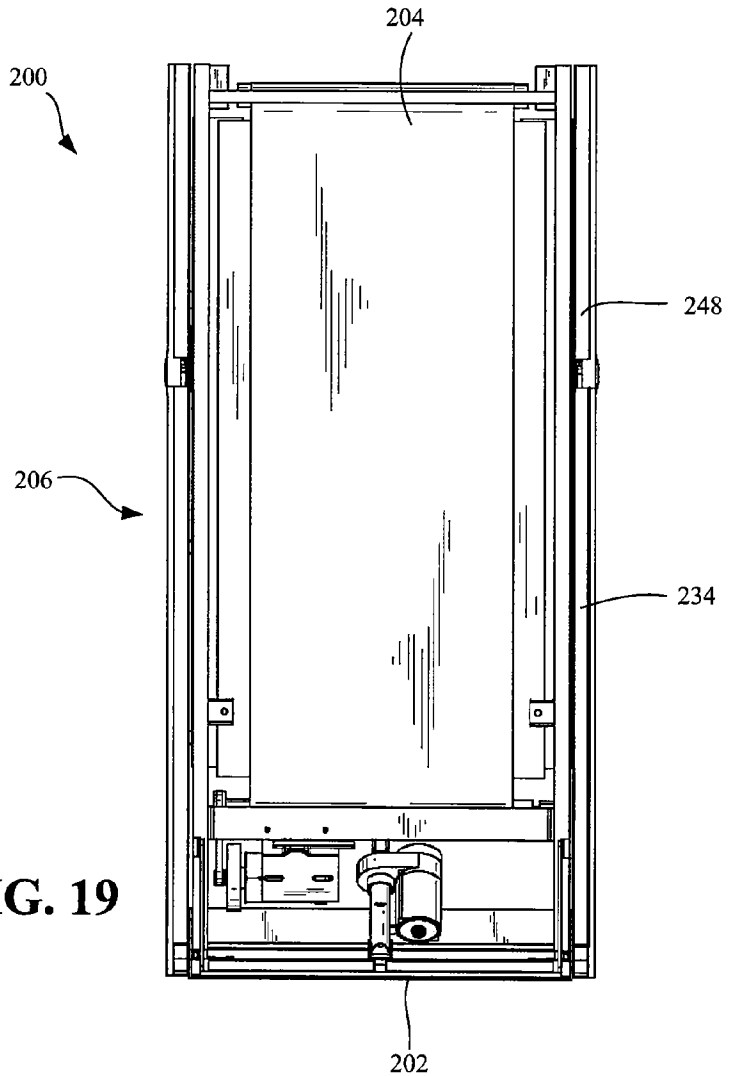
FIG. 19 is a rear view of the treadmill shown in FIG. 17.
Figure 20:
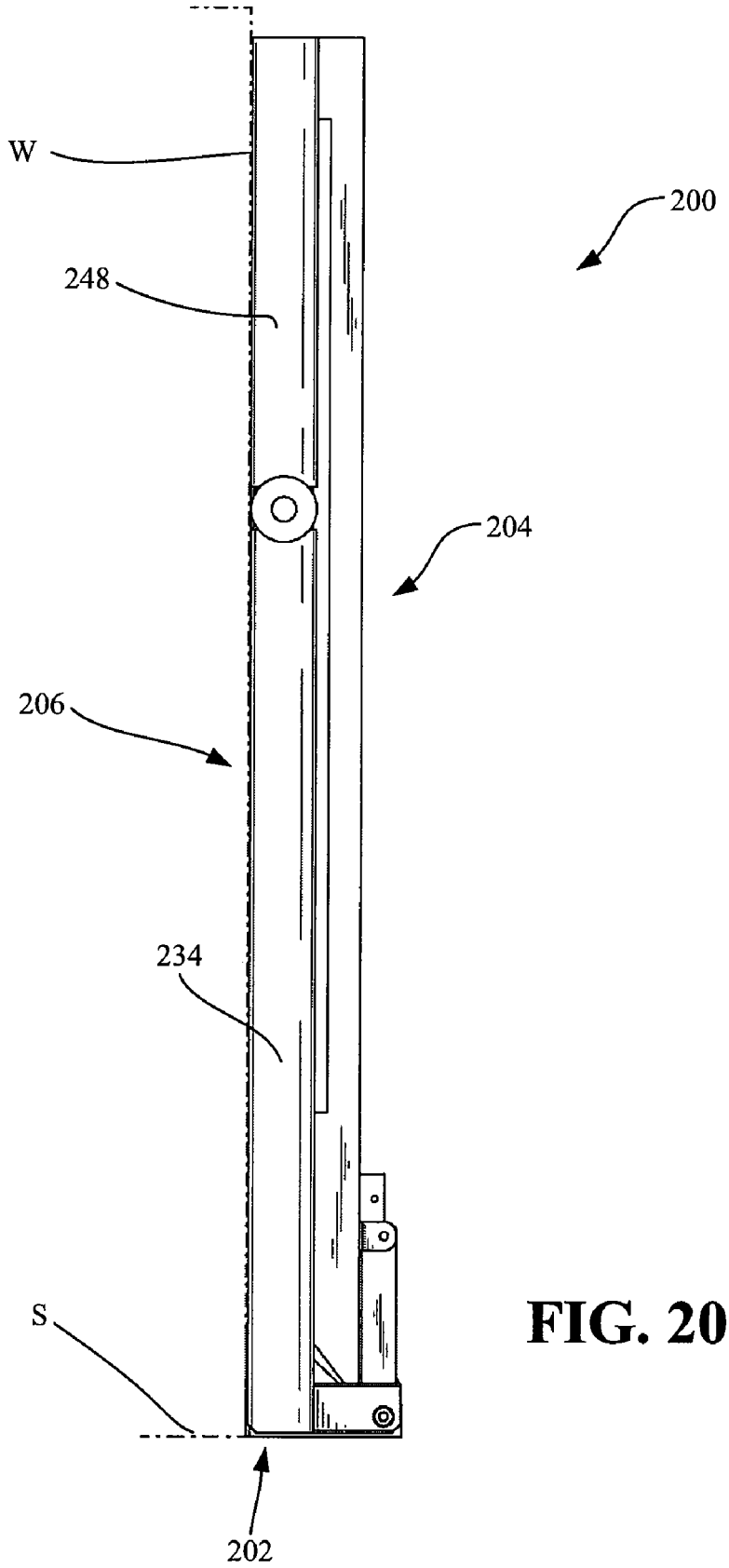
FIG. 20 is a side view of the treadmill shown in FIG. 17.

The panel 246 and the handles 248 are pivoted to a stored position, such as for example, a substantially vertical position, and are substantially aligned with the support post 234 in the stored condition of the treadmill 200. As shown in FIG. 18, the display panel 256 is also moved to a stored position such as, for example, a substantially vertical position. The panel 246, the handles 248, the display panel 256 and the support posts 234 of the control panel support 206 are then substantially parallel to the deck 204 in the stored condition of the treadmill 200.

Referring back to FIGS. 13, 14 and 16, after exercise, the user may manually pivot the panel 246 together with the handles 248 toward the wall W, and, therefore, the control panel assembly 240 is pivoted to align with the control panel support 206. The user then lifts the deck 204 and pivots the deck 204 to the stored position shown FIGS. 17-18. When the deck 204 is in contact with the control panel support 206 during the folding process, the control panel support 206 initiates pivoting together with the deck 204 toward to the stored position. The slider 244 moves toward the lower end of the sliding slot 214 during the folding process. Therefore, the control panel support 206 is also moved to the stored position by simply pivoting the deck 204.

It should be understood that, a linkage could be provided for coordinating the movement between the deck 204 and the control panel support 206, and the linkage could engage with the deck 204 when the deck 204 is lifted to a predetermined level, and the linkage then pivots the control panel support 206 to the stored position during the movement of the deck 204.

When the deck 204 and the control panel support 206 pivot to the corresponding stored positions, the user may operate a locking mechanism (not shown) disposed between the deck 204 and the base bracket 202. In such a manner, the deck 204 and the control panel support 206 are maintained in the stored position by the locking mechanism. It should be understood that the locking mechanism could also be positioned between the deck 204 and the wall W and that the locking mechanism could be any known locking mechanisms such as, for example, hooks, clasps, latches, pins, etc.

Referring back to FIGS. 13, 14, 17 and 18, when the user wants to exercise, the user unlocks the locking mechanism and then pulls the deck 204 back to the surface S. The elastic member 245 pushes the lower end 242 of each support post 234, and the control panel support 206 pivots toward the use position when the deck 204 is pivoted downwardly. The deck 204 is supported on the surface S in the use position, and the slider 244 moves to the upper end of the sliding slot 214 when the control panel support 206 moves to the corresponding use position. The user then pivots the handles 248 to the use position. The user may also pivot the display panel 256 to the use position that facilitates displaying information to the user.

In the fully-folded condition of the treadmill 200, the deck 204, the control panel support 206, the control panel assembly 240 and the handles 248 are positioned within the depth of the base bracket 202. In the fully-unfolded condition of the treadmill 200, the deck 204, the control panel support 206, the control panel assembly 240 and the handles 248 extend beyond the depth of the base bracket 202.

It should be understood that at least one of the deck 204, the control panel support 206, the handles 248 and the display panel 256 could be moved by known mechanism in ways other than by pivoting during the folding/unfolding process. It should also be understood that at least one of the deck 204, the control panel support 206, the handles 248 and the display panel 256 could be automatically moved during the folding/unfolding process.

Figure 21:
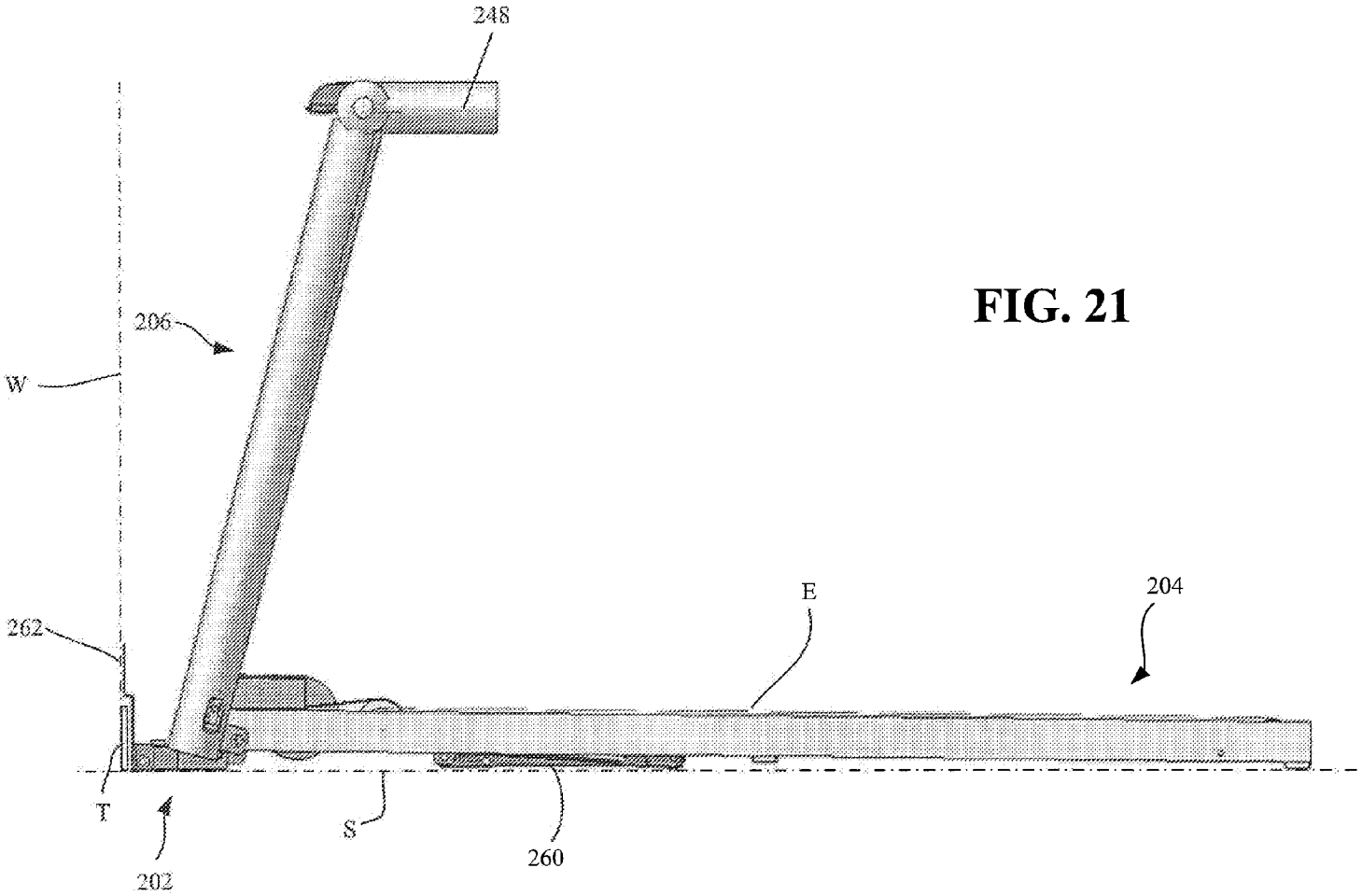
FIG. 21 is a side view of another embodiment of the treadmill shown in FIG. 12.

FIGS. 21-24 illustrate another embodiment of the treadmill 200. As shown in FIG. 21, the deck 204 is pivotably mounted on the base bracket 202, and the control panel support 206 is pivotably mounted on the front end of the deck 204 at a pivot different than the pivot of the deck 204.

Figure 22:
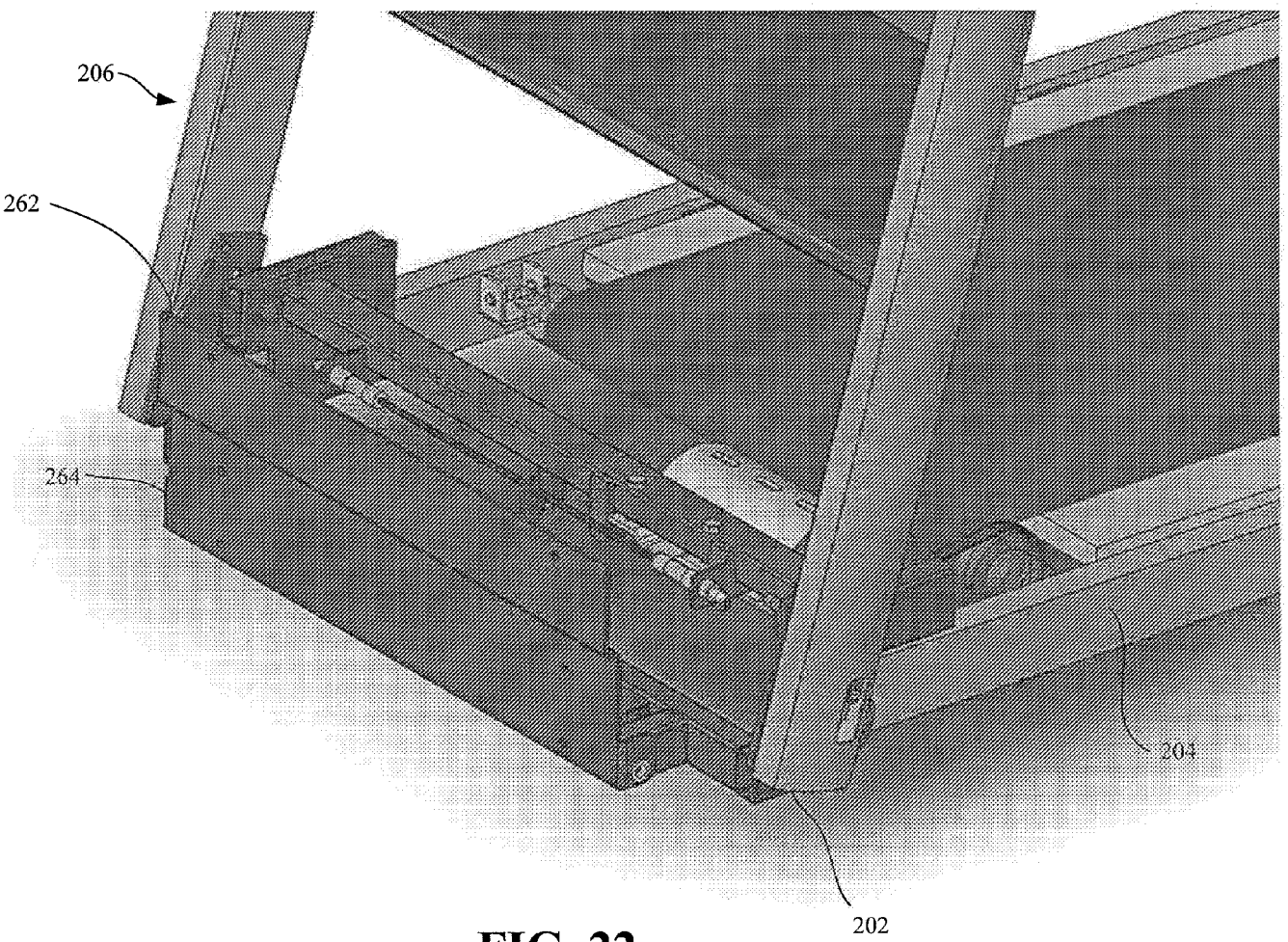
FIG. 22 is a front perspective view of a portion of the treadmill shown in FIG. 21.
Figure 23:
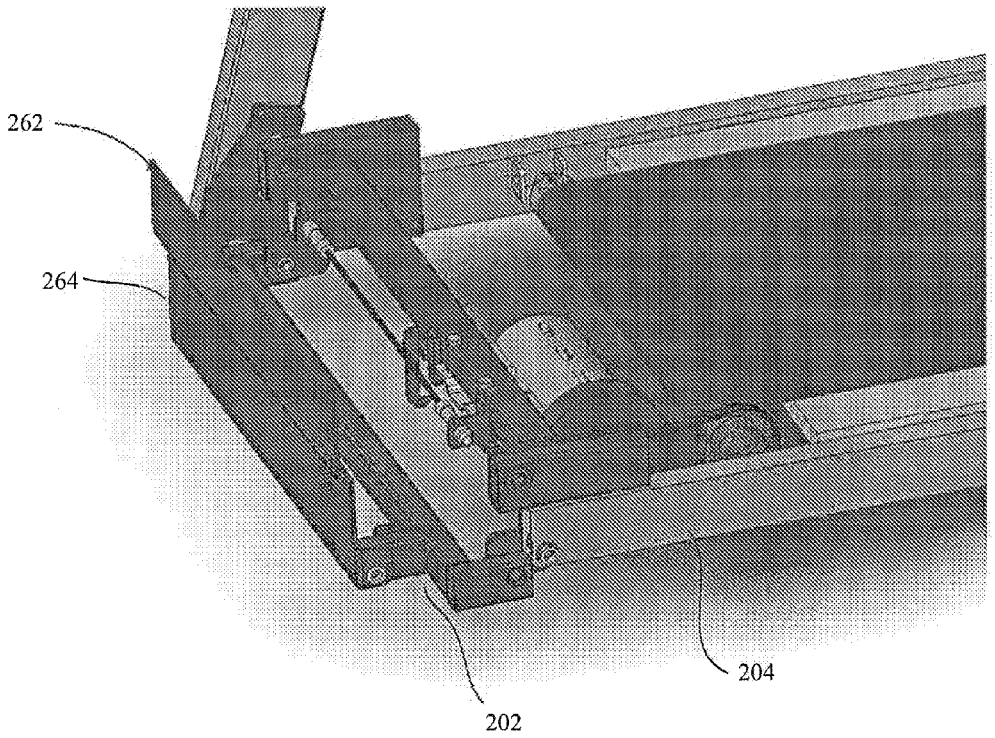
FIG. 23 is a front perspective view of a portion of the treadmill shown in FIG. 21 with some components removed.
Figure 24:
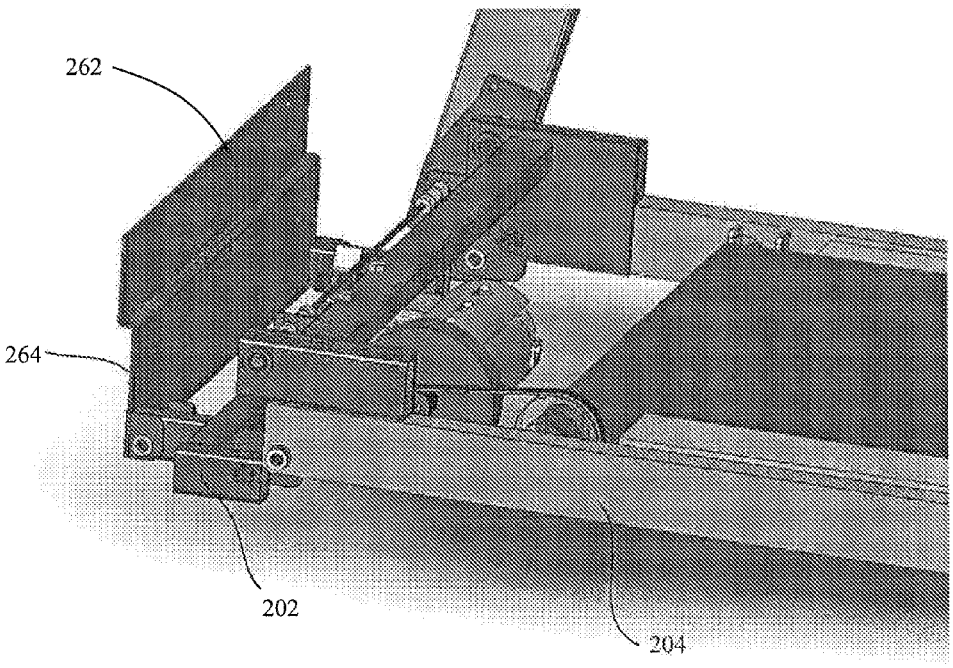
FIG. 24 is a rear perspective view of a portion of the treadmill shown in FIG. 21 with some components removed.

As shown in FIGS. 22-24, the treadmill 200 includes a wall mounting plate 262 for mounting on the wall W. The wall mounting plate 262 includes a recess 264 for receiving a trim strip T which is commonly provided at the lower end of the wall W. The wall mounting plate 262 is pivotably connected with the base bracket 202, such that the base bracket 202 may pivot with respect to the wall mounting plate 262 and with respect to the wall W. The pivotal connection between the wall mounting plate 262 and the base bracket 202 facilitates supporting the base bracket 202 on the surface S in special floor conditions such as, for example, uneven floor surface, carpeted floor surface, other cushioned floor surfaces, etc. It should be understood that the base bracket 202 could be movably connected with the wall mounting plate 262 for various motions such as pivoting, sliding, combinations thereof, etc.

It should also be understood that the movable connection between the wall mounting plate 262 and the base bracket 202 is applicable to other embodiments of the present invention.

As shown in FIG. 21, the treadmill 200 includes an elevating device 266 positioned at the underside of the deck 204 and supportable on the surface S. During the exercise, the elevating device 266 is operable to adjust the incline angle of the exercise surface E. At least when elevated, the deck 204 would be generally supported on the surface S through the elevating device 266.

FIGS. 25-29 illustrate yet another folding treadmill 300. The treadmill 300 is similar to the treadmills 100, 200 shown in FIGS. 1-24. The treadmill 300 is movable between a folded or stored condition (shown in FIG. 25) and an unfolded or use condition (shown in FIG. 28). The treadmill 300 generally includes a deck 302 pivotably mounted on the wall W, a video display 304 operable in a similar manner as the display 170 (shown in FIG. 2) and the display panel 256 (shown in FIG. 14). Two speakers 306 are mounted on the wall W and positioned at two sides of the deck 302.

Figure 25:
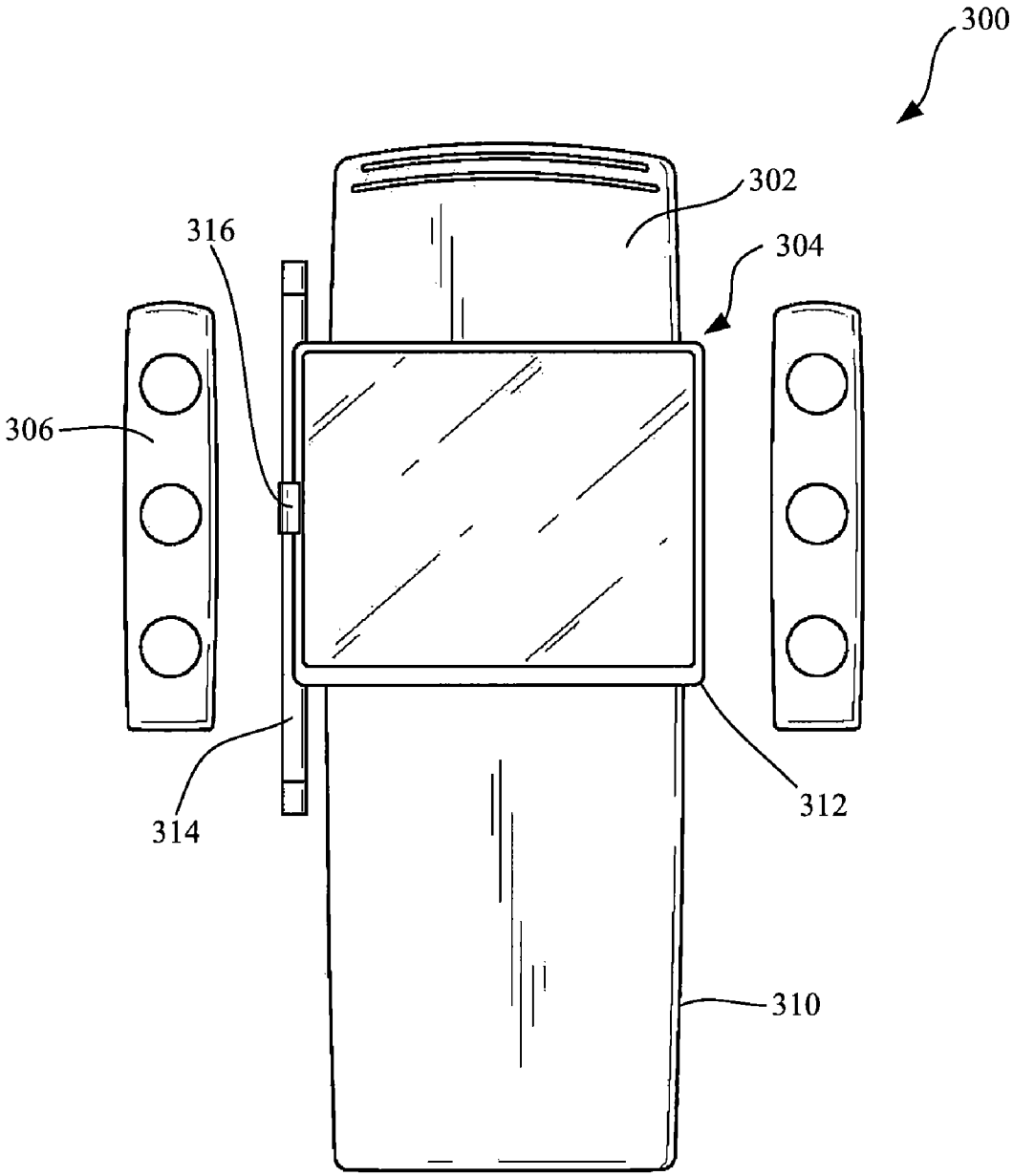
FIG. 25 is a rear view of another treadmill and illustrating a folded or stored position.
Figure 26:
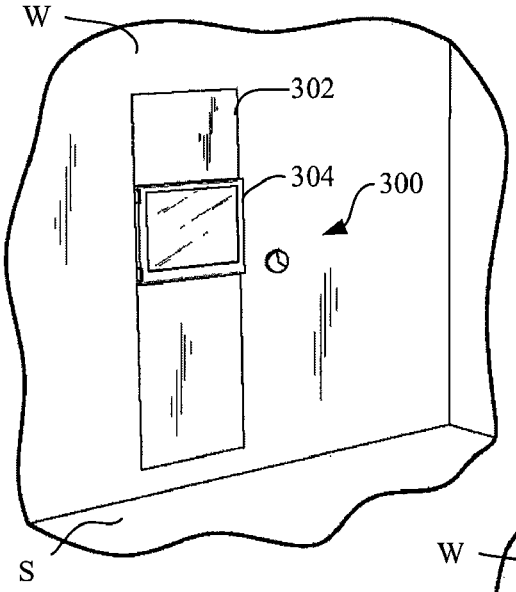
FIG. 26 is a perspective view of the treadmill shown in FIG. 25.
Figure 27:
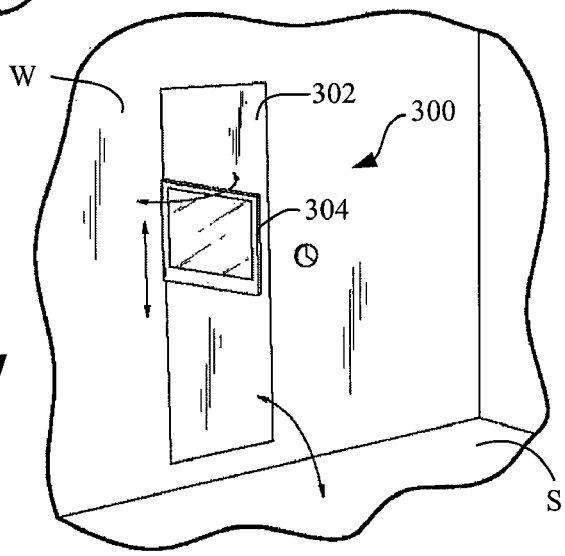
FIG. 27 is a perspective view of the treadmill shown in FIG. 25 with a television pivoted away.
Figure 28:
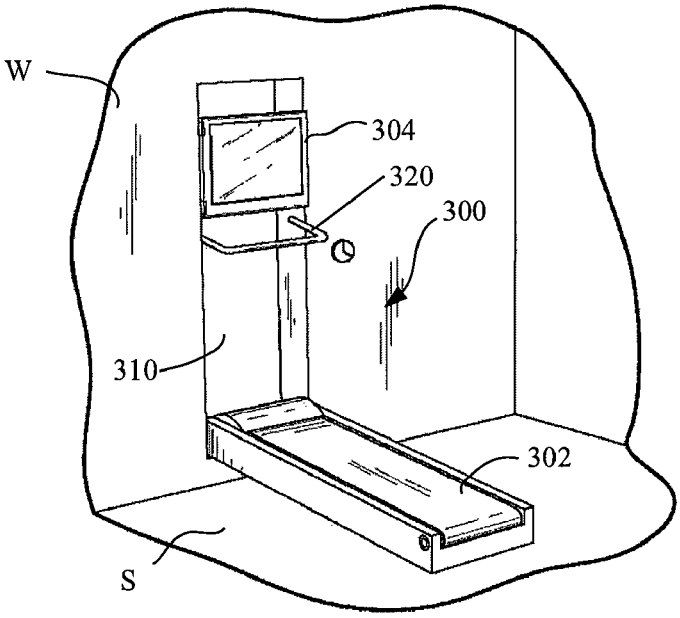
FIG. 28 is a rear perspective view of the treadmill shown in FIG. 25 and illustrating an unfolded or use condition.

As shown in FIGS. 25 and 28, the wall W defines a recess 310, and, in the folded and stored condition of the treadmill 300, the deck 302 is at least partially received within the recess 310.

The video display 304 is placed in a use position and generally includes a display panel 312, a guide rod 314, and a video display support 316 fixed on the display panel 312 and movably engaged with the guide rod 314. The display panel 312 is pivotable about the guide rod 314 and movable along the guide rod 314 so that the height of the video display 304 can be adjusted by moving the display panel 312 upwardly or downwardly along the guide rod 314. The video display 304 may also be pivotable away from the wall W to facilitate folding/unfolding the treadmill. The video display 304 may also include a power/signal line (not shown) extending through the guide rod 314 and into the wall W. The video display 304 is operable to show video programs, etc. in both the stored condition and the use condition of the treadmill 300.

When the user wants to exercise, the user pivots the video display 304 away from the deck 302 to facilitate pivoting the deck 302 downwardly to a use position. The deck 302 is then automatically or manually pivoted to the use position and supported on the surface S in a similar way as the deck 104 or 204 (shown in FIGS. 1-11, FIG. 12 or FIGS. 13-20, FIGS. 21-24). A handle 320 positioned within recess 310 are pivoted to a use position such as, for example, a substantially horizontal position, to provide a user's hand-hold.

The video display 304 is then pivoted back to the use position and is positioned in front of the deck 302. The video display 304 is operable to display the treadmill information and/or the video programs during the exercise. The user may operate an input interface (not shown) of a control panel assembly (not shown) that is similar to the control panel assembly 152 or 240 (shown in FIG. 1-2 or 13-14), and the corresponding treadmill operational information could be displayed on the video display 304.

After exercise, the video display 304 is pivoted away from the recess 310 to facilitate the folding process. The handle 320 and the deck 302 are pivoted back to the corresponding stored position, and video display 304 is then pivoted back to the use position.

It should be understood that, in other constructions, in the stored condition of the treadmill 300, the deck 302 could also be positioned on the wall W instead of in the recess 310 in the wall W. It should also be understood that, in other constructions, the treadmill 300 could be replaced by the treadmill 100 or 200 (shown in FIGS. 1-11, FIG. 12 or FIGS. 13-20, FIGS. 21-24) and the deck 302 could be positioned between the pivotable video display 304 and the wall W in the stored condition of the treadmill 300.

Figure 29:
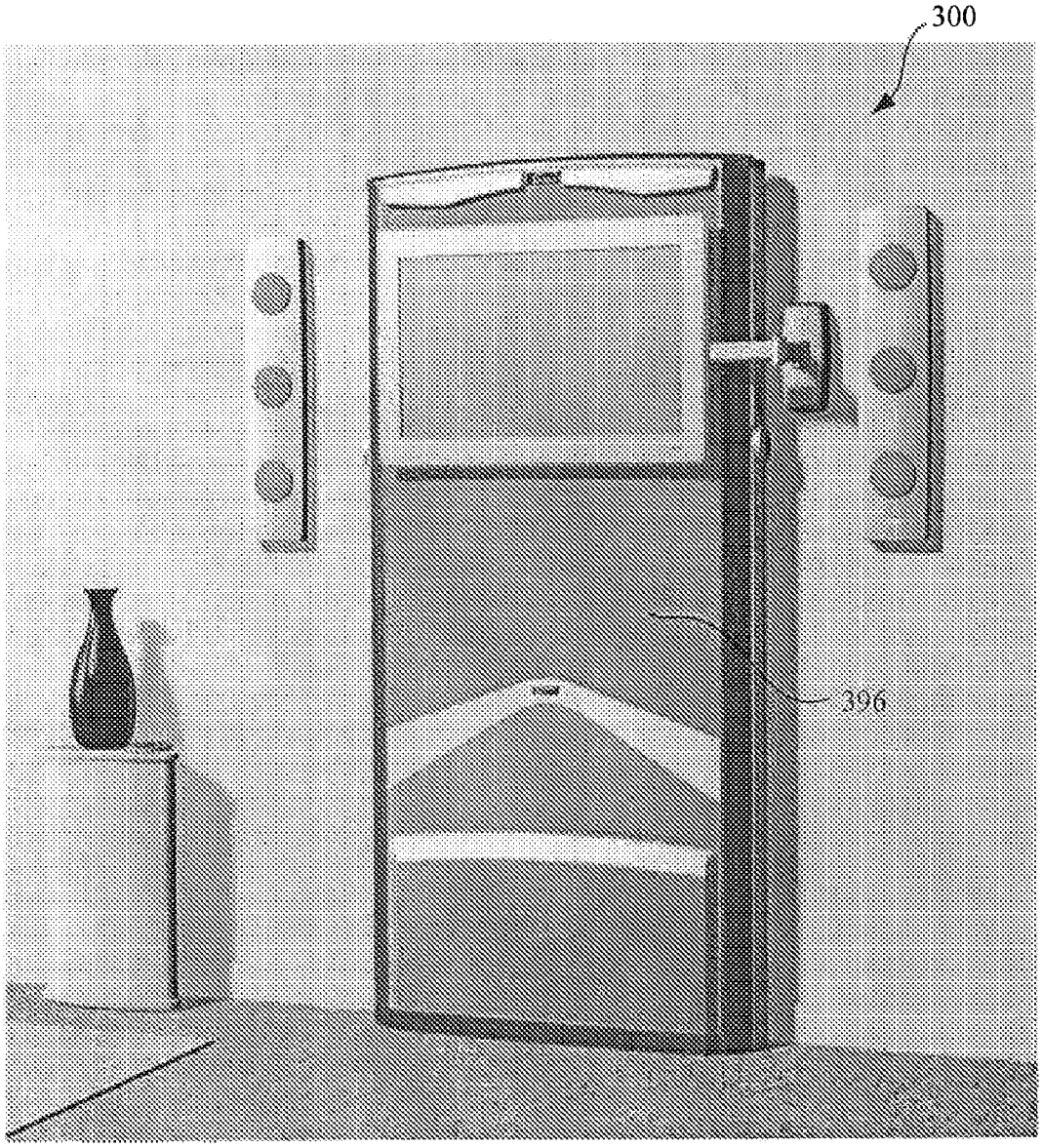
FIG. 29 is a perspective view of a treadmill that is similar to that shown in FIGS. 18-21 and illustrating a folded or stored condition.
Figure 31:
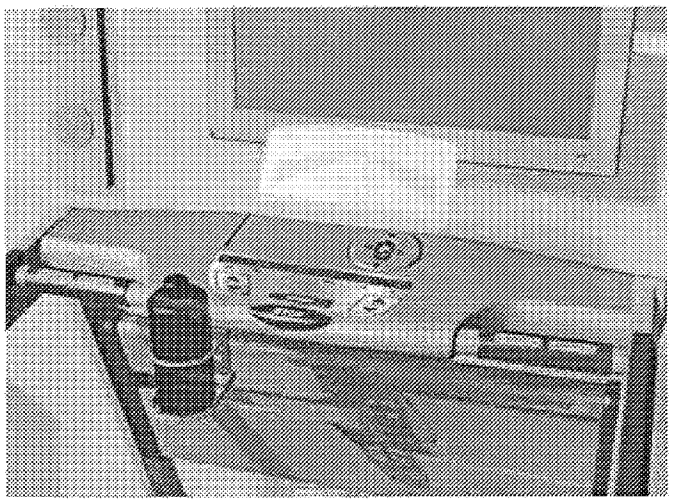
FIG. 31 is an enlarged perspective view of a portion of the treadmill shown in FIG. 30.
Figure 30:
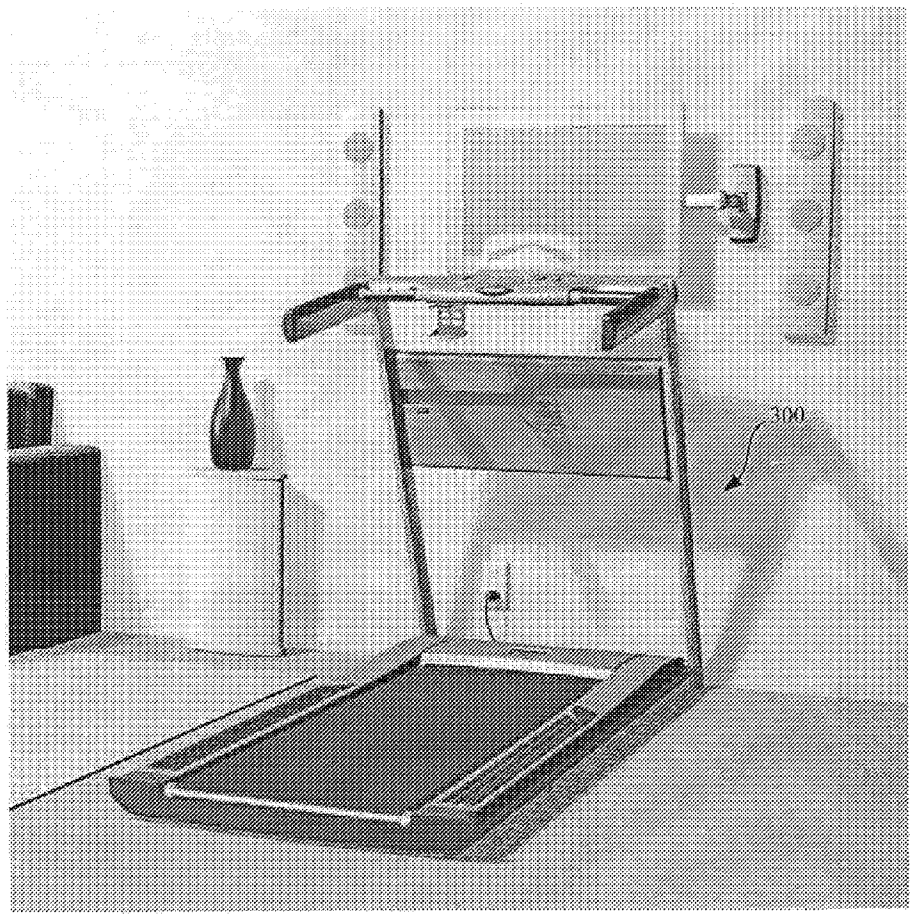
FIG. 30 is a rear perspective view of the treadmill shown in FIG. 29 and illustrating an unfolded or use condition.

FIGS. 29-31 illustrate a treadmill 300 that is similar to the treadmill 300 shown in FIGS. 25-28. In the illustrated construction, the treadmill 300 is not recessed into the wall W, as in the previous construction (illustrated in FIGS. 18-21).

In FIG. 29, the treadmill 300 is illustrated in a folded or stored condition. The outwardly-facing bottom portion of the treadmill deck is provided with a cover 396 which is more visually-appealing, as described above with respect to cover 196. The cover 396 may also be designed to complement and/or provide additional features for the video display 304.

In FIGS. 30-31, the treadmill 300 is illustrated in an unfolded or use condition. In the illustrated construction, the treadmill 300 includes structure which is similar to the treadmill 200 shown in FIGS. 13-20, FIGS. 21-24. The treadmill 300 may include a base bracket, a deck pivotably mounted on the base bracket, a mast or control panel support pivotably mounted on the base bracket at the same pivot of the deck, and handles movably supported on the control panel support (similar to the base bracket 202, the deck 204, the control panel support 206 and the handles 248 shown in FIGS. 12-20).

In another embodiment (not shown) of the treadmill 300, the video display 304 includes a projector (not shown) positioned in the exercise area. The projector projects video program on the underside of the deck 302 in the stored condition of the treadmill 300, and projects video program on the corresponding area of the recess 310 in the use condition of the treadmill 300. Therefore, the movement of the video display will be unnecessary during the folding/unfolding process. It should be understood that a screen could be provided on the appropriate area on at least one of the underside of the deck 302 and the recess 310 to facilitate the displaying.

In some other constructions (not shown), the control panel support and/or the handles(s) may be further movable when the treadmill 100, 200 or 300 is in the use condition to facilitate a user preference (e.g., to further incline the control panel support, to lift/lower the handle(s), etc.). The associated linkages, if provided, or separate structure may operate to enable this additional positioning movement and to hold the control panel support and/or the handle(s) in the further user selected position.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention.

What is claimed is:

1. A foldable treadmill, comprising:

a base bracket adapted to be coupled to a substantially vertical surface;

a deck operationally coupled to the base bracket for moving between a use position and a substantially vertical stored position;

a continuous belt rotatably coupled to the deck and configured to provide a walking surface for an exercise user;

at least a support post extending upwardly and coupled to the deck; and at least one handle pivotally coupled to the support post;

wherein the base bracket further comprises a mounting plate and a secondary link, wherein the mounting plate is adapted to be coupled to a substantially vertical surface, and wherein the secondary link is pivotally coupled to the mounting plate at a first pivot axis and pivotally coupled to the deck at a parallel second pivot axis.

2. The foldable treadmill of claim 1, wherein the at least one handle is substantially parallel with the deck when the deck is in the stored position.

3. The foldable treadmill of claim 1, further comprising a control panel movably coupled proximate the top portion of the support post.

4. The foldable treadmill of claim 1, further comprising a control panel movably coupled proximate the top portion of the support post, wherein the control panel is substantially parallel with the deck when the deck is in the stored position.

5. The foldable treadmill of claim 1, wherein the secondary link can pivot about the first pivot axis to raise or lower the position of the second pivot axis.

* * * * *